US008919903B2

(12) United States Patent
Yamasaki

(10) Patent No.: US 8,919,903 B2
(45) Date of Patent: Dec. 30, 2014

(54) NAIL PRINTING DEVICE INCLUDING PRINTING HEAD THAT PERFORMS PRINTING ON FINGERNAIL, AND PRINTING CONTROL METHOD

(75) Inventor: Shuichi Yamasaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 128 days.

(21) Appl. No.: 13/464,295

(22) Filed: May 4, 2012

(65) Prior Publication Data

US 2012/0287192 A1 Nov. 15, 2012

(30) Foreign Application Priority Data

May 9, 2011 (JP) ..... 2011-104022

(51) Int. Cl.
*B41J 29/38* (2006.01)
*B41J 3/407* (2006.01)

(52) U.S. Cl.
CPC ..... *B41J 3/407* (2013.01); *B41J 3/4073* (2013.01)
USPC ..... 347/14

(58) Field of Classification Search
USPC ..... 347/1, 14, 15
See application file for complete search history.

(56) References Cited

U.S. PATENT DOCUMENTS

| | | | | |
|---|---|---|---|---|
| 5,309,365 | A * | 5/1994 | Sullivan et al. | 700/161 |
| 5,439,013 | A * | 8/1995 | Hoover | 132/76.5 |
| 5,931,166 | A * | 8/1999 | Weber et al. | 132/73 |
| 5,934,290 | A * | 8/1999 | Carroll et al. | 132/73 |
| 6,067,996 | A * | 5/2000 | Weber et al. | 132/73 |
| 6,286,517 | B1 * | 9/2001 | Weber et al. | 132/73 |
| 6,336,694 | B1 * | 1/2002 | Ishizaka | 347/2 |
| 7,123,983 | B2 * | 10/2006 | Yogo et al. | 700/182 |
| 2004/0143359 | A1 * | 7/2004 | Yogo et al. | 700/161 |
| 2007/0092624 | A1 * | 4/2007 | Iwasaki et al. | 426/597 |

FOREIGN PATENT DOCUMENTS

JP 2003-534083 A 11/2003

OTHER PUBLICATIONS

Machine English translation of CN1984579A abstract.*

* cited by examiner

*Primary Examiner* — Julian Huffman
*Assistant Examiner* — Sharon A Polk
(74) *Attorney, Agent, or Firm* — Holtz, Holtz, Goodman & Chick PC

(57) ABSTRACT

A nail printing device includes: a printing head which implements printing for a nail of a finger; a fingernail image obtaining unit which picks up a region containing the nail, and obtains a nail region image from a picked-up image; a nail tip region extraction unit which extracts a nail tip region of the nail, the nail tip region not overlapping a nail bed of the finger, from the nail region image; and a shape adjustment-required region extraction unit which positionally aligns a model nail image with the nail region image, and extracts, as a shape adjustment-required region, a region located outward of an outline of the model nail image in the nail tip region.

18 Claims, 24 Drawing Sheets

NAIL PRINTING DEVICE INCLUDING PRINTING HEAD THAT PERFORMS PRINTING ON FINGERNAIL, AND PRINTING CONTROL METHOD

CROSS-REFERENCE TO RELATED APPLICATIONS

This application is based upon and claims the benefit of priority from the prior Japanese Patent Application No. 2011-104022, filed on May 9, 2011, the entire contents of which are incorporated herein by reference.

BACKGROUND OF THE INVENTION

1. Field of the Invention

The present invention relates to a nail printing device including a printing head that performs printing on a fingernail, and to a printing control method.

2. Description of Related Art

Published Japanese Translation of International Patent Publication No. 2003-534083 proposes a nail printing device that prints nail designs with varieties of colors, patterns and the like on a fingernail. If the nail printing device as described above is used, then a user can easily enjoy nail printing at home or the like, without having to go to a shop such as a nail salon.

Incidentally, as shapes of a tip end portion of the nail, there are a plurality of shapes such as point, oval, round, square-off, and square. In the case of implementing the nail design for the nail at the nail salon or the like, the shape of the nail is selected in response to the preference of the user, the nail design desired to be implemented, and the like before implementing the nail design for the nail. Then, in general, a shape-adjusting (or filing) operation for adjusting the tip end portion of the nail to a desired shape is performed in such a manner that a special technician files the nail of the user by a file and the like.

In terms of this point, in the case where the user performs the nail printing at home or the like by the nail printing device, it is necessary for the user to perform such a shape-adjusting operation for the nail by him/herself.

However, it is extremely difficult for an ordinary person who is not accustomed to such an operation to determine which part of the nail and to which extent the nail should be filed for adjusting the tip end portion of the nail to the desired shape.

That is to say, since a size, shape, extension degree and the like of the nail differ among the respective fingers, such a spot to be filed and such a filing extent must be decided in response to a status of each of the nails.

Moreover, for the purpose of accurately specifying the spot to be filed, it is also conceived for the user to make, on the nail, a rough copy of such a filing subject spot by him/herself before the shape-adjusting operation; however, in particular, in the event of adjusting a shape of a nail of the dominant hand, it is difficult to make a rough copy of the filing subject spot on the nail by him/herself, and it is far more difficult to file the nail as desired.

Therefore, in the case where the user performs the shape-adjusting operation for the nail by him/herself, there have been problems that matching is not achieved among lengths and shapes of the nails already subjected to the shape adjustment, that a total balance among the nails is deteriorated, that the nails cannot help but being given up from the adjustment to the desired shapes since the nails are filed too much, and so on.

The present invention has been made in consideration of the circumstances as described above. It is an object of the present invention to provide a nail printing device and a printing control method, which enable even a user who is not accustomed to the shape adjustment of the nail to easily adjust the nail to the desired shape.

SUMMARY OF THE INVENTION

According to an aspect of the present invention, there is provided a nail printing device including:

a printing head which implements printing for a nail of a finger;

a fingernail image obtaining unit which picks up an image of a region containing the nail, and obtains a nail region image from the picked-up image;

a nail tip region extraction unit which extracts a nail tip region of the nail, the nail tip region not overlapping a nail bed of the finger, from the nail region image; and a shape adjustment-required region extraction unit which positionally aligns a model nail image with the nail region image, and extracts, as a shape adjustment-required region, a region located outward of an outline of the model nail image in the nail tip region.

According to another aspect of the present invention, there is provided a printing control method of a nail printing device, the printing control method comprising:

picking up an image of a region containing a nail of a finger, and obtaining a nail region image from the picked-up image;

extracting a nail tip region of the nail, the nail tip region not overlapping a nail bed of the finger, from the nail region image; and positionally aligning a model nail image with the nail region image, and extracting, as a shape adjustment-required region, a region located outward of an outline of the model nail image in the nail tip region.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENT

First Embodiment

A description is made of a first embodiment of a nail printing device according to the present invention while referring to FIG. 1 to FIG. 16B.

Figure 1:
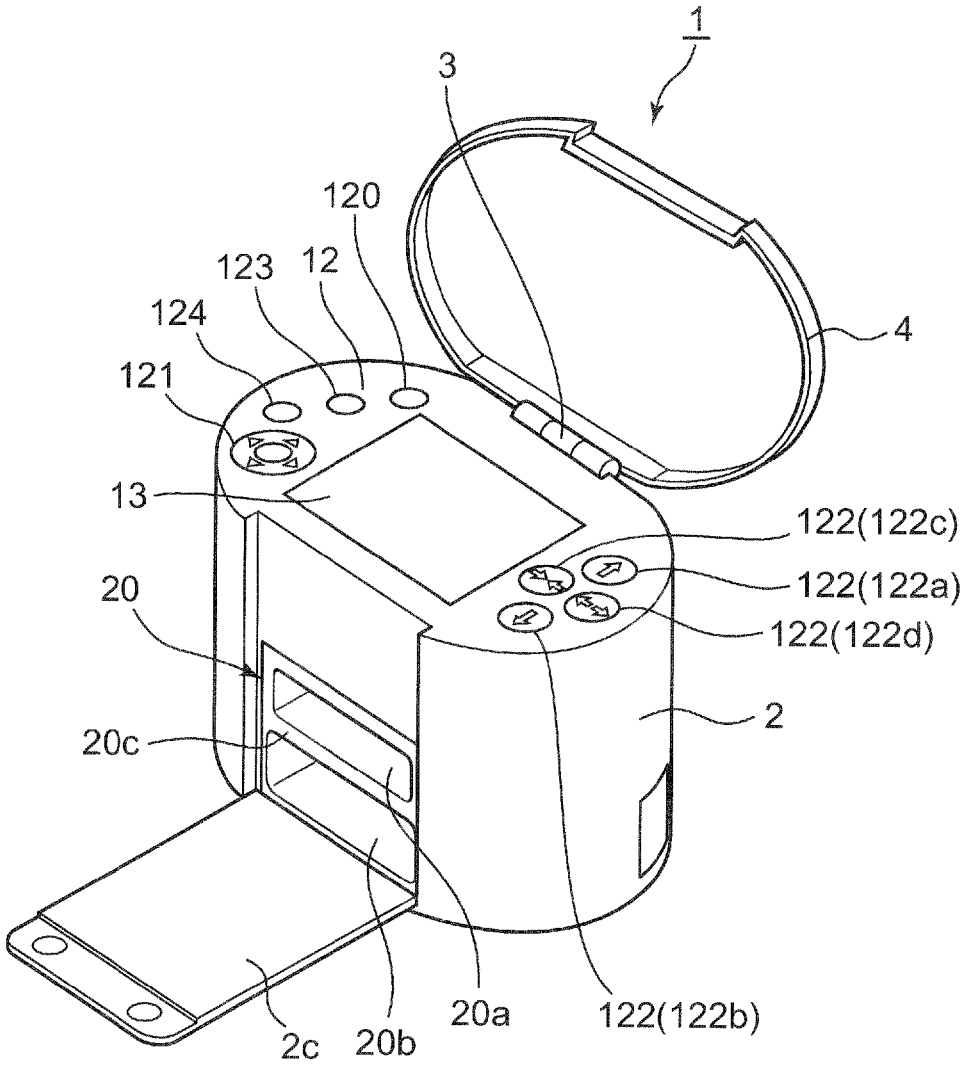
FIG. 1 is a perspective view conceptually showing an embodiment of a nail printing device according to the present invention, showing a state where a lid body is open.
Figure 2:
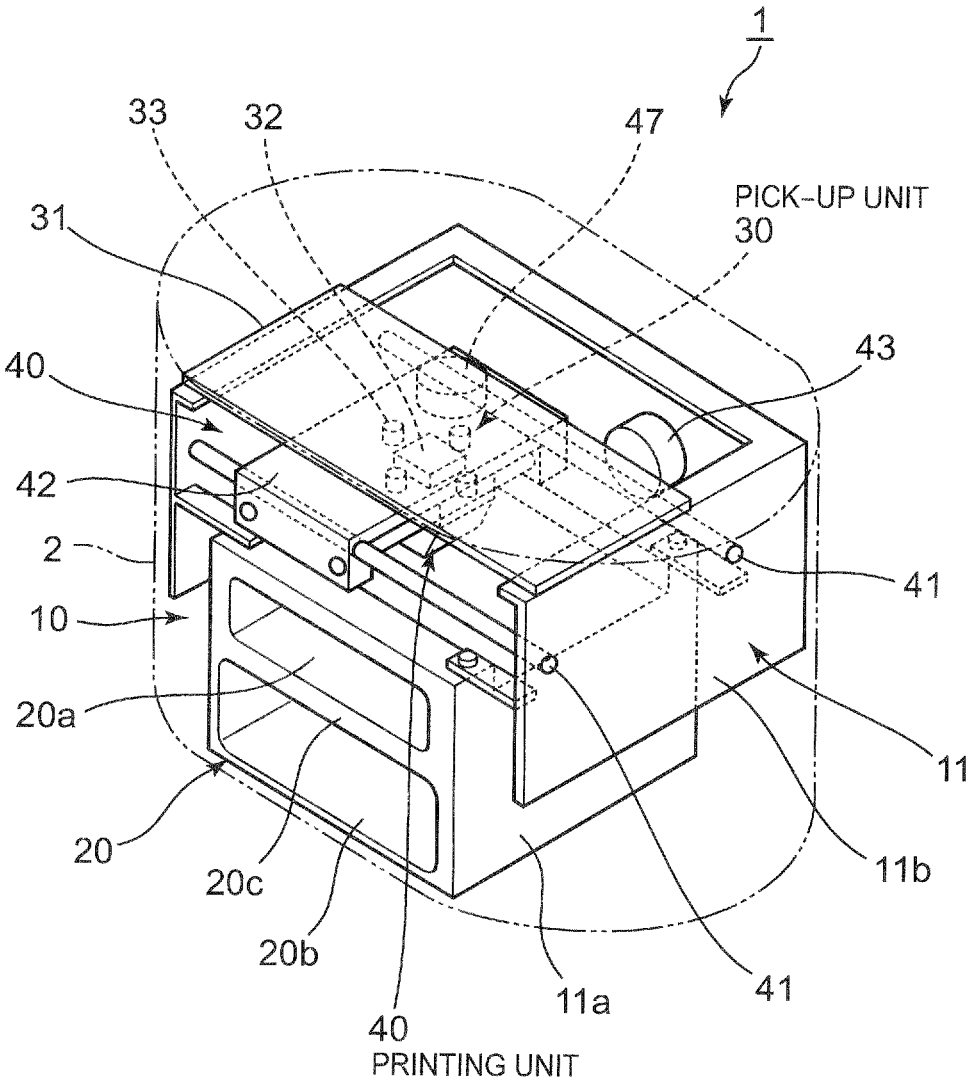
FIG. 2 is a perspective view conceptually showing a device body of the nail printing device of FIG. 1.

FIG. 1 is a perspective view showing an exterior appearance of the nail printing device in this embodiment, and FIG. 2 is a perspective view showing an internal configuration of the nail printing device.

As shown in FIG. 1, this nail printing device 1 includes: a case body 2; and a lid body 4. This case body 2 and this lid body 4 are coupled to each other through a hinge 3 provided on a rear end portion of an upper surface of the case body 2.

The case body 2 described above is formed into an ellipsoidal shape when viewed from the above. On a front side of the case body 2, an open/close plate 2*c* is provided so as to be capable of rising and falling. This open/close plate 2*c* is coupled to the case body 2 through a hinge (not shown) provided on a lower end portion of a front surface of the case body 2. This open/close plate 2*c* is a plate for opening/closing the front surface of the case body 2.

Moreover, on the upper surface (top plate) of the case body 2, an operation unit 12 to be described later is installed, and on a substantial center portion of the upper surface (top plate), a display unit 13 is set.

Note that shapes and configurations of the case body 2 and the lid body 4 are not limited to those illustrated here.

Moreover, in the case body 2, a device body 10 of the nail printing device 1 is housed. As shown in FIG. 2, this device body 10 includes: a printing finger fixing unit 20; a pick-up unit 30; a printing unit 40; a control device 50 (refer to FIG. 6) that composes a control unit; and the like. The printing finger fixing unit 20, the pick-up unit 30, the printing unit 40 and the control device 50 are provided on a machine casing 11.

Note that the machine casing 11 is composed of a lower machine casing 11*a* and an upper machine casing 11*b*. Then, the lower machine casing 11*a* is formed into a box shape, and is installed in a lower portion of an inside of the case body 2, and the upper machine casing 11*b* is installed above the lower machine casing 11*a* and an upper portion in the inside of the case body 2.

The printing finger fixing unit 20 is provided in the lower machine casing 11*a* in the machine casing 11. The printing finger fixing unit 20 is composed of a printing finger insertion portion 20*a*, a non-printing finger insertion portion 20*b* and a grip portion 20*c*, which are provided in the lower machine casing 11*a*.

Here, the printing finger insertion portion 20*a* is a finger insertion portion (refer to FIG. 3) for receiving insertion of fingers (hereinafter, referred to as "printing fingers") U1 corresponding to nails T to be subjected to the printing. A bottom surface (printing finger mounting surface) of the printing finger insertion portion 20*a* functions as a finger mounting portion that mounts the printing fingers U1 thereon. The picking-up and printing of the printing fingers U1 are performed in a state where the printing fingers U1 are mounted on the printing finger mounting surface of the printing finger insertion portion 20*a*, which serves as the finger mounting portion.

Moreover, the non-printing finger insertion portion 20*b* is a finger insertion portion for receiving insertion of a finger (hereinafter, referred to as "a non-printing finger") U2 other than the printing fingers (refer to FIG. 3).

Furthermore, the grip portion 20*c* is a portion capable of being sandwiched by the printing fingers U1 inserted into the printing finger insertion portion 20*a* and the non-printing finger U2 inserted into the non-printing finger insertion portion 20*b*. In this embodiment, this grip portion 20*c* is composed of a partition 21 that partitions the printing finger insertion portion 20*a* and the non-printing finger insertion portion 20*b* from each other.

An upper surface of this partition 21 composes the printing finger mounting surface that is flat. A swelling portion 22 is formed on a finger insertion-side end portion of this partition 21. This swelling portion 22 is formed at a portion against which a base U3 of the printing fingers U1 and the non-printing finger U2 abut in the event where the printing fingers U1 and the non-printing finger U2 are deeply inserted into the printing finger insertion portion 20*a* and the non-printing finger insertion portion 20*b*. In the swelling portion 22, a cross section thereof in a finger insertion direction is formed into a circular shape so as to swell downward from a lower surface of the partition 21 in order that the partition 21 (grip portion 20*c*) can be strongly sandwiched by the printing fingers U1 and the non-printing finger U2 in a state where the whole of the cushions of the printing fingers U1 abuts against the printing finger mounting surface. Note that the shape of the swelling portion is not limited to the circular shape in cross section, and may be ellipsoidal in cross section, polygonal in cross section, and the like.

Figure 3:
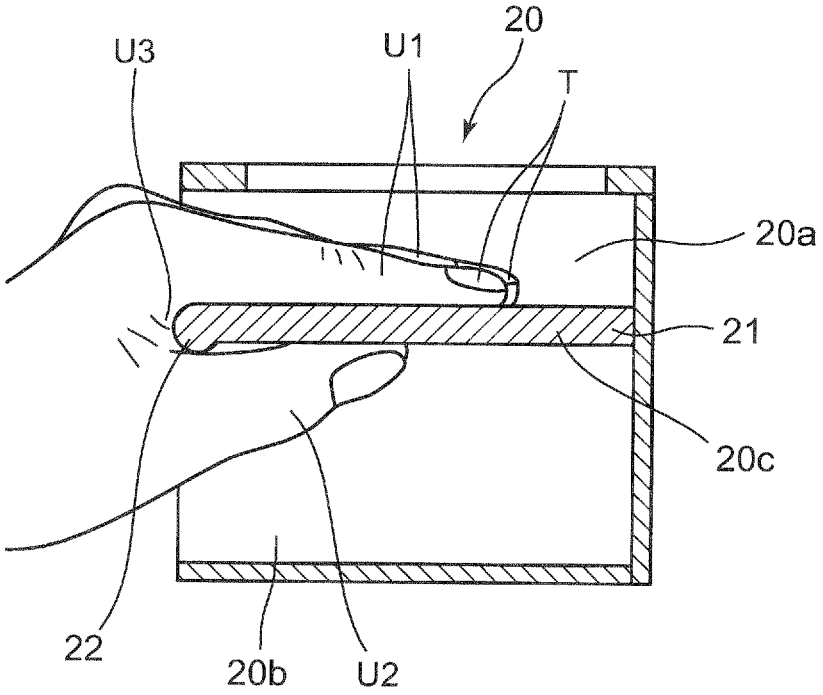
FIG. 3 is a cross-sectional view showing a printing finger fixing unit of the nail printing device of FIG. 1, showing a mode where the forefinger to the little finger as printing fingers are fixed to the nail printing device in an event of inserting the forefinger to the little finger into a printing finger insertion portion.

For example, in the case where four fingers (forefinger, middle finger, ring finger and little finger) of the left hand, which are other than the thumb, are set as the printing fingers U1, then as shown in FIG. 3, the user inserts the four printing fingers U1 into the printing finger insertion portion 20*a*, and inserts the thumb as the non-printing finger U2 into the non-printing finger insertion portion 20*b*. In this case, the grip portion 20*c* is sandwiched by the printing fingers U1 inserted into the printing finger insertion portion 20*a* and by the non-printing finger U2 inserted into the non-printing finger insertion portion 20*b*, whereby the printing fingers U1 are fixed onto the grip portion 20*c*.

Moreover, in the case where only the thumb is set as such a printing finger U1, the thumb (printing finger U1) is inserted into the printing finger insertion portion 20*a*, and the four fingers (non-printing fingers U2) other than the thumb are inserted into the non-printing finger insertion portion 20*b*. Also in this case, the user sandwiches the grip portion 20*c* by the printing finger U1 and the non-printing fingers U2, whereby the printing finger U1 is fixed.

Figure 4:
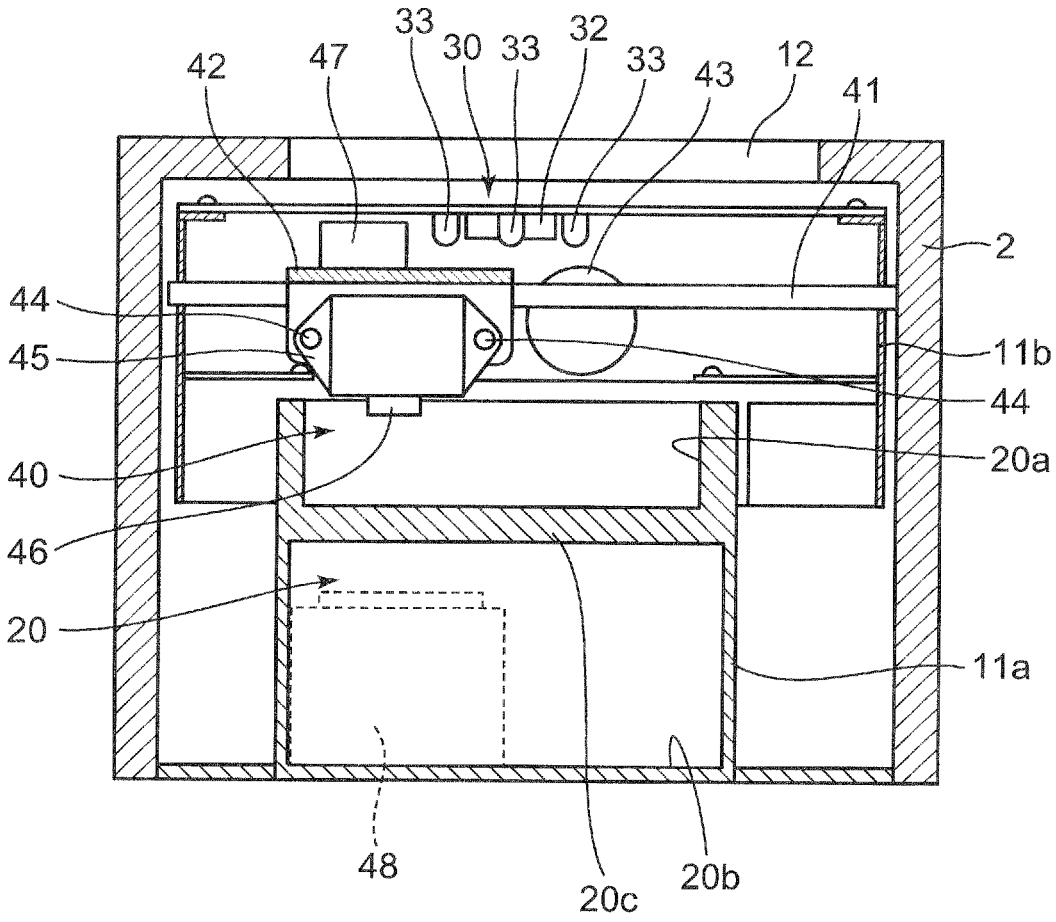
FIG. 4 is a cross-sectional view of a front side of the nail printing device of FIG. 1.
Figure 5:
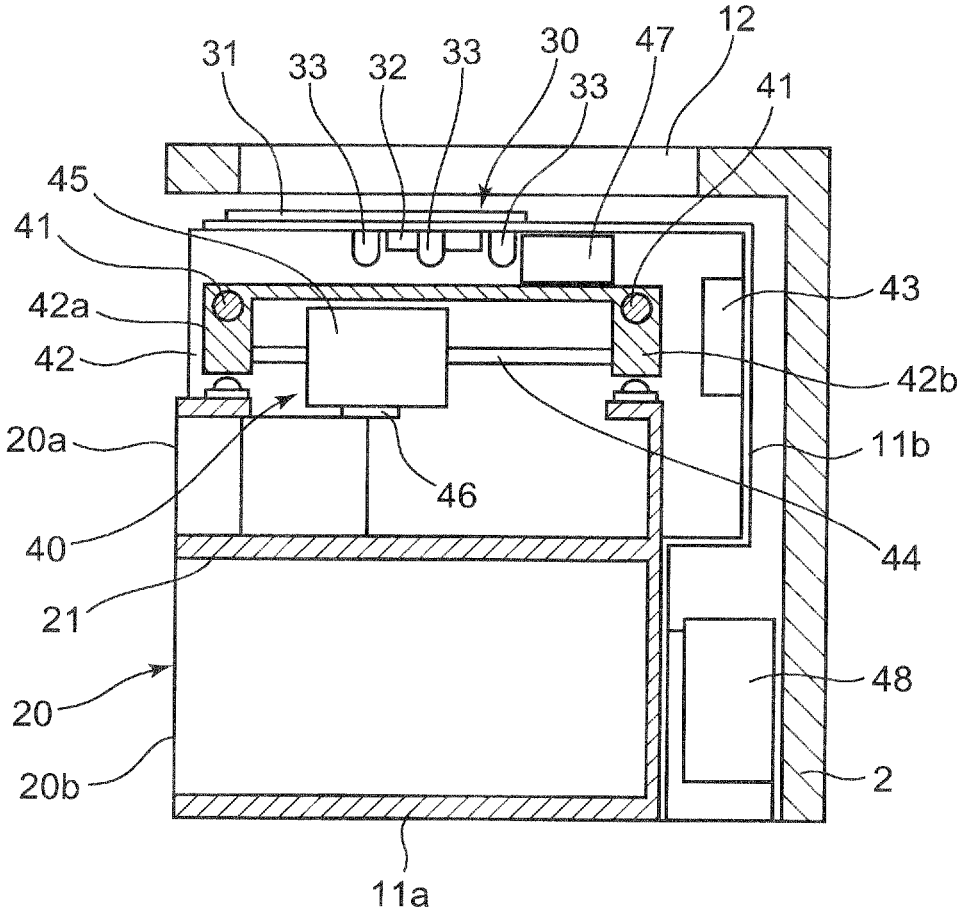
FIG. 5 is aside cross-sectional view of the nail printing device of FIG. 1.

Moreover, FIG. 4 is a cross-sectional view of a front side of the nail printing device 1 according to this embodiment, and FIG. 5 is a side cross-sectional view of the nail printing device 1.

As shown in FIG. 4 and FIG. 5, the pick-up unit 30 is provided in the upper machine casing 11*b* in the machine casing 11.

That is to say, on a lower surface of a center portion of a board 31 installed in the upper machine casing 11*b*, a camera 32 is installed, which has a driver built therein, and has approximately 2 million pixels or more. Moreover, on the board 31, illumination lamps 33 such as white LEDs are installed so as to surround the camera 32. The pick-up unit 30 is composed by including the camera 32 and the illumination lamps 33.

The pick-up unit 30 is a fingernail image obtaining unit that illuminates the printing fingers U1, which are mounted on the printing finger insertion portion 20*a* as the finger mounting portion, by the illumination lamps 33, picks up the printing fingers U1 concerned by the camera 32, and obtains a fingernail image including a nail region image of the nails T corresponding to the printing fingers U1. This pick-up unit 30 is connected to a control unit 51 of the control device 50 to be described later, and is controlled by the control unit 51.

Moreover, the printing unit 40 is a unit that prints colors, patterns and the like on the nails T (refer to FIG. 3) of the printing fingers U1. In this embodiment, the printing unit 40 is a printing unit that prints, by a predetermined color, an image showing regions necessary to be filed off by the shape adjustment (filing) in the nails T, that is, an image clearly showing shape adjustment-required regions Fa (refer to FIG. 9) on the nails T, which are extracted by a shape adjustment-required region extraction unit 513 (refer to FIG. 6) to be described later.

Figure 9:
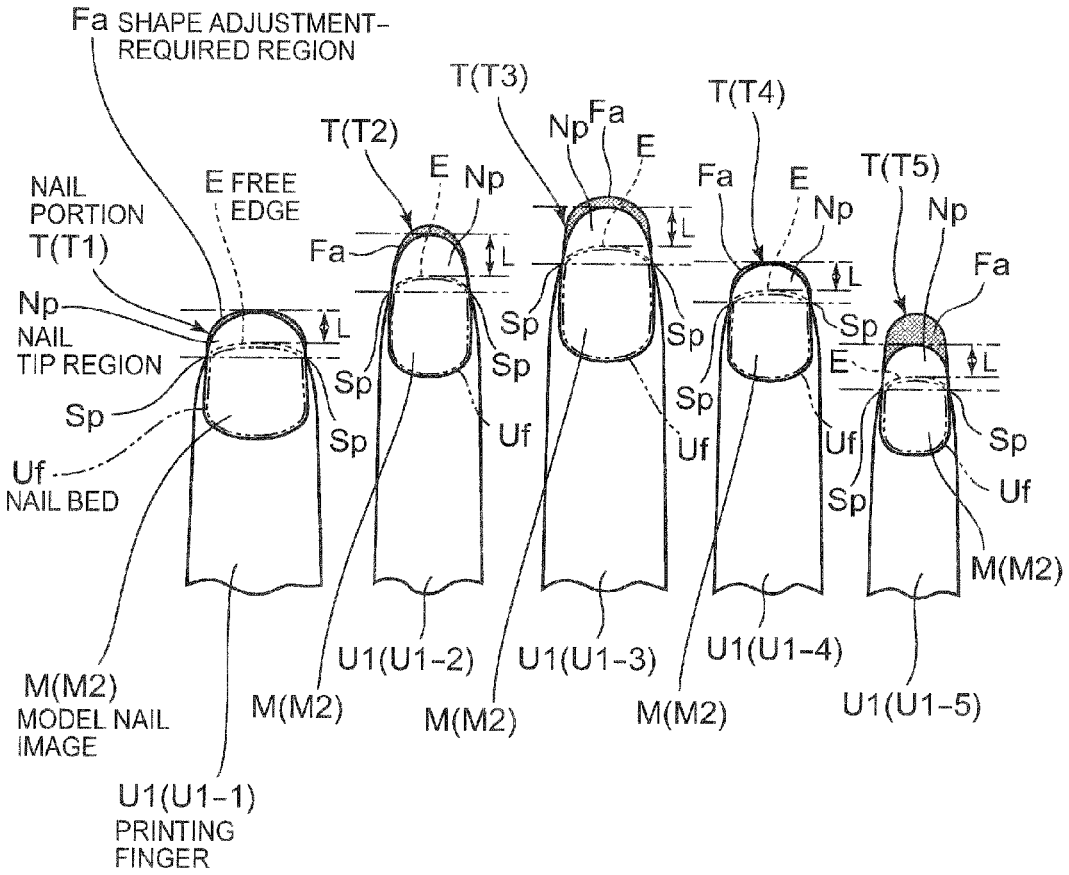
FIG. 9 is an explanatory view showing positional relationships between nail tip regions and shape adjustment-required regions in nails in the first embodiment.
Figure 15A:
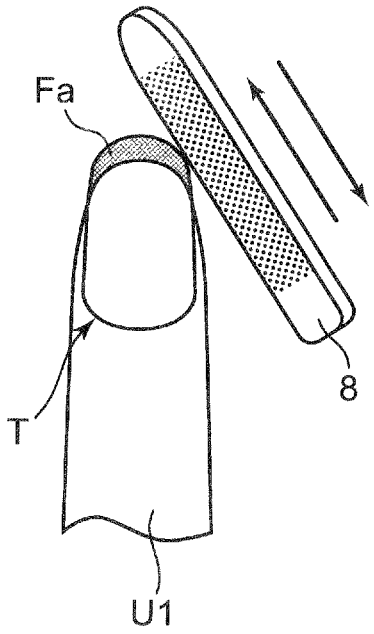
FIG. 15A is an explanatory view showing a state of performing shape adjustment by using a file in a case where printing is implemented on a whole of the shape adjustment-required region.
Figure 15B:
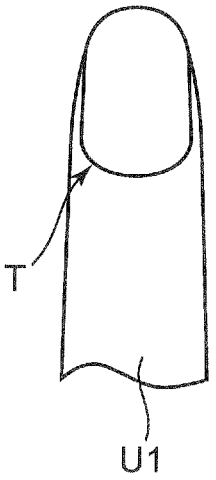
FIG. 15B is a view showing a state after the shape adjustment.
Figure 16A:
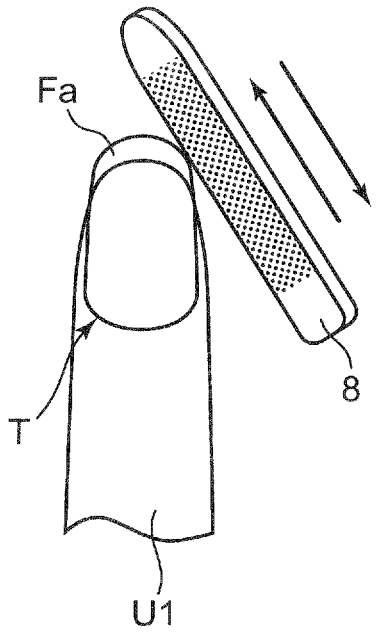
FIG. 16A is an explanatory view showing a state of performing shape adjustment by using the file in a case where printing is implemented on a boundary line between the shape adjustment-required region and other region.

Here, the image clearly showing the shape adjustment-required regions Fa may be, for example as shown in FIG. 9 and FIG. 15A, an image in which the whole of the regions extracted as the shape adjustment-required regions Fa by the shape adjustment-required region extraction unit 513 is shown by a predetermined color, or as shown in FIG. 16A, may be an image in which a boundary line between such a shape adjustment-required region Fa and other nail region is shown by a predetermined color. In either case, by the file and the like, the user files the shape adjustment-required region Fa until the color printed as the image clearly showing the same becomes invisible, and can thereby adjust the shape of the nail T of the user's own to a desired nail tip shape (refer to FIG. 15B and FIG. 16B).

Note that the case of printing the whole of the shape adjustment-required region Fa is superior in a point where it is easy for the user to grasp the region necessary to be filed off by the file and the like, and meanwhile, the case of printing only the boundary line is superior in a point where an amount of ink for use in the printing is saved. With regard to which image is to be printed as the image clearly showing the shape adjustment-required region Fa, either one may be determined as a default, or either one may be arbitrarily selectable and settable by the user.

Moreover, the predetermined color for printing the region extracted as the shape adjustment-required region Fa or the boundary line between the shape adjustment-required region Fa and the other nail region is not particularly limited; however, preferably, is a color such as red and black, which is conspicuous in the event of being printed on the nail T.

Note that, in this embodiment, the description is made while taking as an example the case of printing red on the whole of the region extracted as the shape adjustment-required region Fa (refer to FIG. 15A).

In this embodiment, the printing unit 40 is provided mainly in the upper machine casing 11*b*.

That is to say, as shown in FIG. 4 and FIG. 5, on both side plates of the upper machine casing 11*b*, two guide rods 41 are bridged in parallel to each other. On the guide rods 41, a main carriage 42 is installed freely slidably. Moreover, as shown in FIG. 5, on a front wall 42*a* and rear wall 42*b* of the main carriage 42, two guide rods 44 are bridged in parallel to each other. On the guide rods 44, a sub-carriage 45 is installed freely slidably. A printing head 46 is mounted on a center portion of a lower surface of this sub-carriage 45.

In this embodiment, this printing head 46 is an ink jet-type printing head that converts ink into fine droplets, and directly sprays the fine droplets to a printed medium, thereby performing printing. Note that a recording method of the printing head 46 is not limited to the ink jet method.

The main carriage 42 is coupled to a motor 43 through a power transmission unit (not shown), and is configured so as to move in a right-and-left direction along the guide rods 41 by forward and reverse rotations of the motor 43. Moreover, the sub-carriage 45 is coupled to a motor 47 through a power transmission unit (not shown), and is configured so as to move in a fore-and-aft direction along the guide rods 44 by forward and reverse rotations of the motor 47.

Moreover, in the lower machine casing 11*a*, an ink cartridge 48 for supplying the ink to the printing head 46 is provided. The ink cartridge 48 is connected to the printing head 46 through an ink supply pipe, and appropriately supplies the ink to the printing head 46. Note that a configuration in which the ink cartridge is mounted on the printing head 46 itself may be adopted.

The printing head 40 is composed by including the guide rods 41, the main carriage 42, the motor 43, the guide rods 44, the sub-carriage 45, the printing head 46, the motor 47, the ink cartridge 48, and the like. The motor 43, printing head 46 and motor 47 of this printing unit 40 are connected to a printing control unit 514 of the control device 50 to be described later, and is controlled by the printing control unit 514.

In this embodiment, in the case where a usual printing button 123 (refer to FIG. 1) to be described later is operated, printing of an image of a design D on the nail T of the printing finger U1 is performed by the printing unit 40.

Moreover, in the case where a filing printing start button 124 (refer to FIG. 1) is operated, there is performed filing printing of printing an image, which clearly shows the shape adjustment-required region Fa extracted by the shape adjustment-required region extraction unit 513, on the corresponding nail T by a predetermined color (for example, red). In this embodiment, specifically, when the filing printing start button 124 is operated, red color printing is implemented for the region on the nail T, which is extracted as the shape adjustment-required region Fa by the shape adjustment-required region extraction unit 513.

The operation unit 12 is an input unit for allowing the user to perform a variety of inputs.

In this embodiment, for example, as shown in FIG. 1, in the operation unit 12, there are provided: a power supply button 120 that turns on a power supply of the nail printing device 1; a setting button 121 that designates a model nail image M and the nail design D, each of which has a desired shape; fine adjustment buttons 122 which finely adjust a shape adjustment state of the nail T; the usual printing button 123 as a switch that starts the printing of the usual nail design D and the like; the filing printing start button 124 for starting the shape adjustment-use (filing-use) printing that prints the image clearly showing the shape adjustment-required region Fa; and the like.

The setting button 121 is composed of a selection portion showing vertical and horizontal directions, and of a decision portion located at a center thereof. By the selection portion, the user selects the model nail image M and the nail design D, each of which has the desired shape, from among a plurality of the model nail images M and a plurality of the nail designs D, which are registered in advance in the nail printing device 1, in a state where a nail shape designation screen (refer to FIG. 8) and a nail design designation screen (not shown) are displayed on the display unit 13 to be described later. Then, the user operates the decision portion, and can thereby designate the model nail image M thus selected and the nail design D thus selected. The plurality of model nail images M are different from one another in at least either of the size and the shape.

Figure 8:
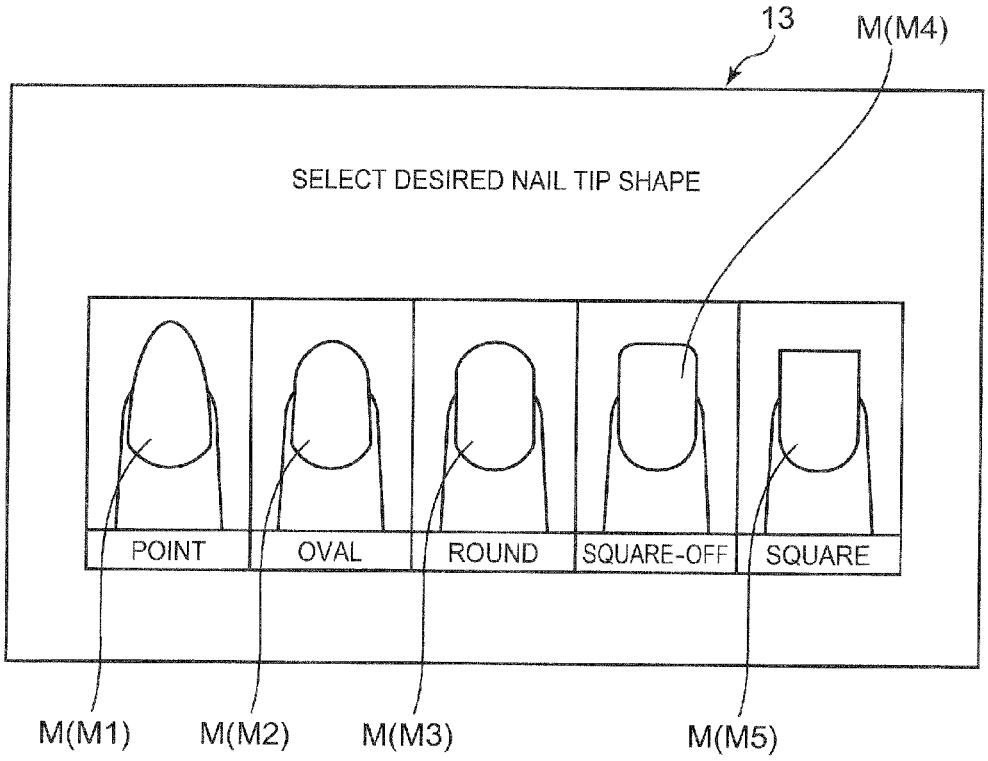
FIG. 8 is a view showing an example of a nail shape designation screen.

In this embodiment, as the model nail images M serving as models in the event where the user adjusts the nail tip shape of the nail T, five types of the model nail images M different in the nail tip shape are displayed on the nail shape designation screen (refer to FIG. 8). The five types are: point (model nail image M1); oval (model nail image M2); round (model nail image M3); square-off (model nail image M4); and square (model nail image M5). The setting button 121 functions as a nail shape designation unit that designates one model nail image M from among such a plurality of model nail images M.

Note that the number of model nail images M capable of being designated by the setting button 121 is not limited to the number mentioned here. A larger number of the model nail images M may be prepared, or the model nail image M may be designated from among a smaller number thereof.

Moreover, the fine adjustment buttons 122 are composed of four buttons, which are: a longitudinal direction extending button 122*a* that extends the shape adjustment-required region Fa in the longitudinal direction; a longitudinal direction contracting button 122*b* that contracts the shape adjustment-required region Fa in the longitudinal direction; a lateral direction contracting button 122*c* that contracts the shape adjustment-required region Fa in the lateral direction; and a lateral direction extending button 122*d* that extends the shape adjustment-required region Fa in the lateral direction. The user appropriately operates the fine adjustment buttons 122 (122*a* to 122*d*) in a state where a shape adjustment-required region fine adjustment screen is displayed on the display screen of the display unit 13 to be described later, and can thereby finely adjust longitudinal and lateral dimensions of the shape adjustment-required region Fa (refer to FIG. 13 and FIG. 14).

Moreover, in the case where the usual printing button 123 is operated, the printing of performing usual nail print, such as printing of the image of the nail design D such as a flower pattern and coloring of the whole of the nail T, is performed for the nail T of the printing finger U1 by the printing unit 40.

In the case where the filing printing start button 124 is operated, filing printing of coloring with red or the like is performed for the region on the nail T, which is extracted as the shape adjustment-required region Fa.

The display unit 13 is a display unit composed, for example, of a liquid crystal display panel (LCD panel) and the like.

Note that, on a surface of the display unit 13, a touch panel may be composed integrally therewith. In this case, the display unit 13 is configured so as to be capable of receiving a variety of inputs also by a touch of the surface of the display unit 13 concerned, which is performed by a touching operation using a stylus pen, a fingertip and the like, any of which is not shown.

On the display unit 13, for example, there are displayed: a fingertip image obtained by picking up the printing fingers U1; a nail region image indicating the nail T thereamong; the nail design D to be printed on the nail T of such a printing finger U1; a thumbnail image for design confirmation; a variety of designation screens; and the like.

Moreover, in this embodiment, on the display unit 13, the nail shape designation screen shown in FIG. 8 is displayed, and the plurality of model nail images M realizably by adjusting the shapes of the nails T of the user are displayed in line. In this embodiment, as the model nail images M, the five types of nail tip shapes, which are point, oval, round, square-off and square (model nail images M1 to M5), are selectable. As shown in FIG. 8, the five types of model nail images M are displayed on the nail shape designation screen.

Note that, in the case where the touch panel is composed integrally on the surface of the display unit 13, then just by an action of the user to touch the image of the desired model nail image M on the screen, the model nail image M concerned may be designated as the model nail image M in the event of adjusting the shape of the nail T. In this case, the display unit 13 also functions as the nail shape designation unit that designates one model nail image M from among the plurality of model nail images M.

Figure 10:
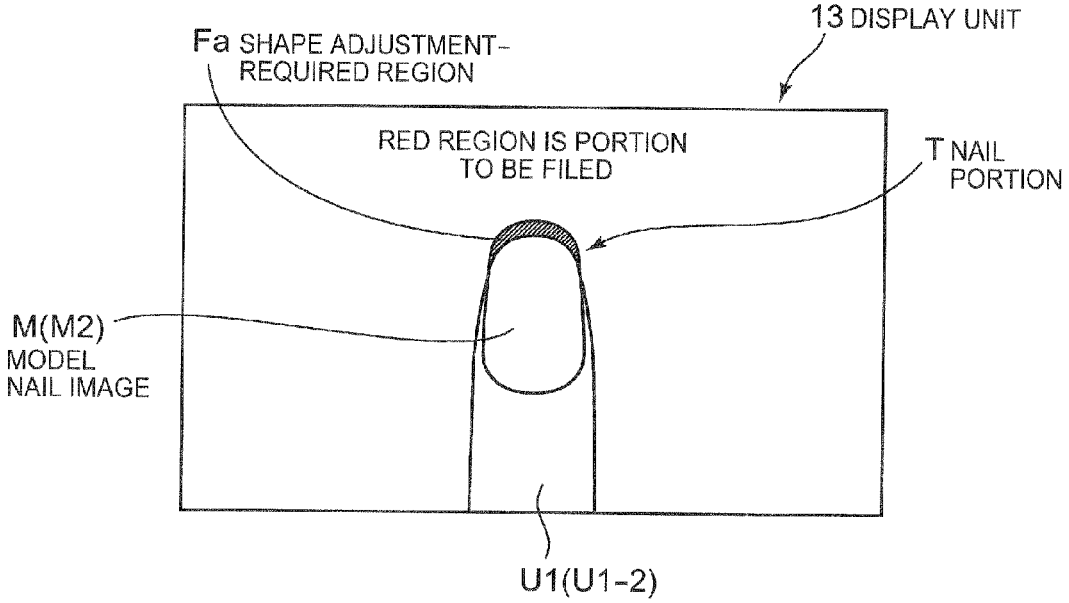
FIG. 10 is a view showing an example of a shape adjustment-required region confirmation screen in the first embodiment.

Moreover, on the display unit 13, such a shape adjustment-required region confirmation screen as shown in FIG. 10 is displayed.

Figure 6:
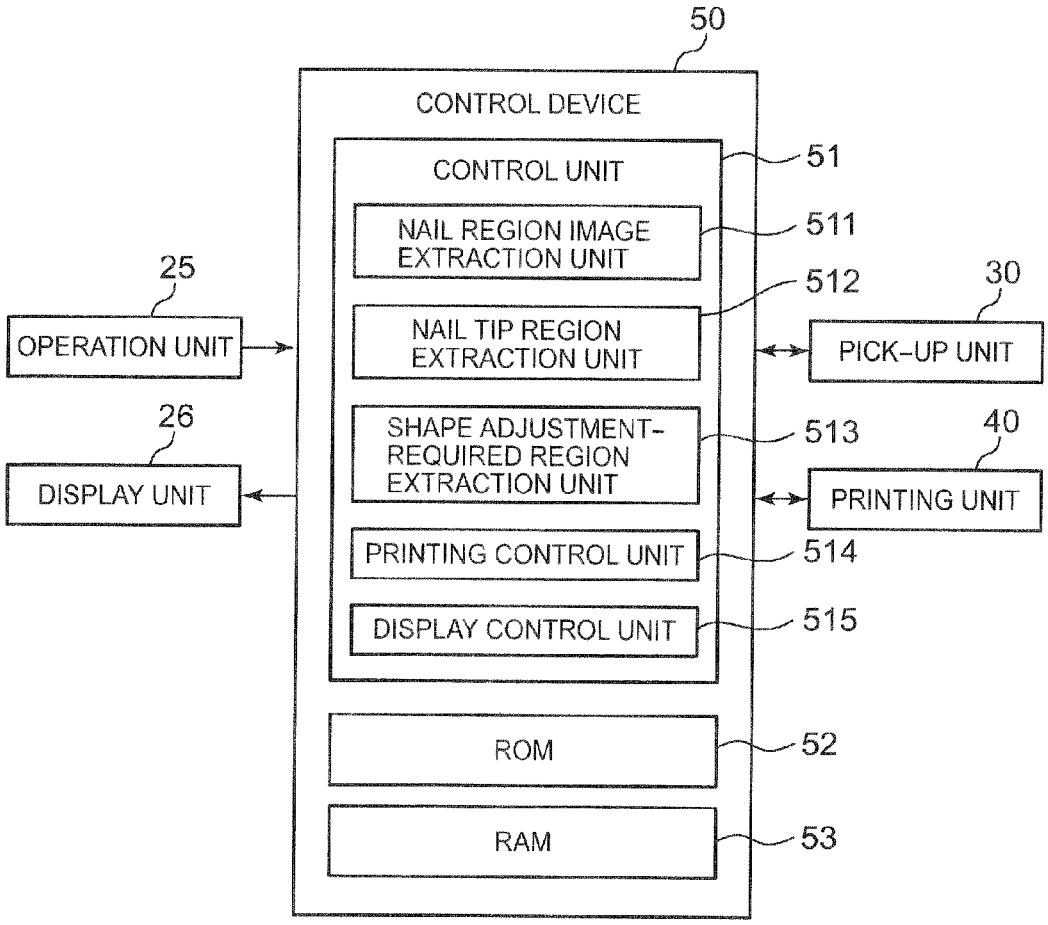
FIG. 6 is a main portion block diagram showing a control configuration of the nail print device according to this embodiment.

The shape adjustment-required region confirmation region is a region that displays an image clearly showing the shape adjustment-required region Fa extracted as a region located outward from an outline of each model nail image M by the shape adjustment-required region extraction unit 513 (refer to FIG. 6). Here, the shape adjustment-required region Fa is a nail tip region Np (refer to FIG. 9) of the nail T extracted by the nail tip region extraction unit 512 (refer to FIG. 6), the nail tip region Np being obtained by positionally aligning the designated model nail image M with the nail region image of the nail T of the user. Then, the display unit functions as a shape adjustment-required region display unit.

In this embodiment, as shown in FIG. 10, on the shape adjustment-required region confirmation screen, the fingernail image of the user is displayed in a state where the whole of the region extracted as the shape adjustment-required region Fa from the nail region thereof is colored with red. Here, a comment saying "red region is a portion to be filed" follows the fingernail image.

Figure 11:
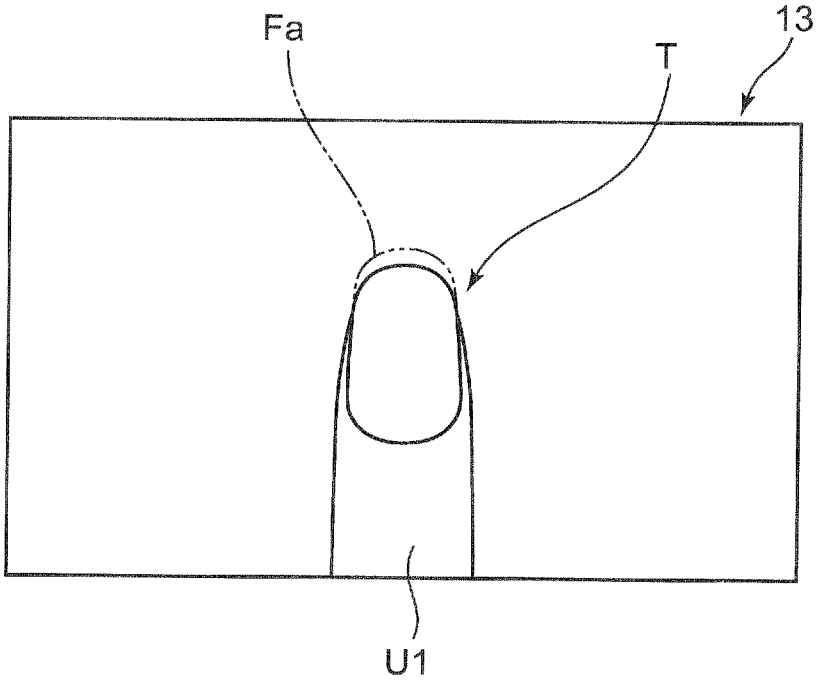
FIG. 11 is a view showing an example of a post-shape adjustment shape confirmation screen.

Moreover, on the display unit 13, such a post-shape adjustment shape confirmation screen as shown in FIG. 11 is displayed.

The post-shape adjustment shape confirmation screen shows a shape of the nail T, which is obtained after the shape adjustment, while giving transparency to the shape adjustment-required region Fa, for example, colored with red on the shape adjustment-required region confirmation screen.

The post-shape adjustment shape confirmation screen is displayed, whereby the user can confirm a state of the nail T, from which the shape adjustment-required region Fa is already filed off, on the screen of the display unit 13. Therefore, it becomes easy for the user to determine whether or not the nail T of the user's own can be formed into the desired shape by filing the presented shape adjustment-required region Fa.

Figure 12:
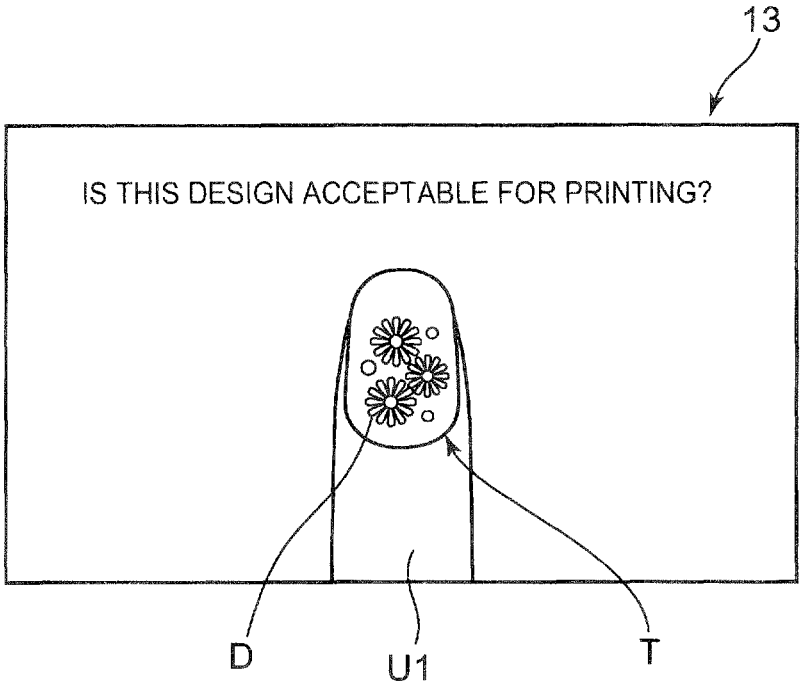
FIG. 12 is a view showing an example of a design confirmation screen.

Moreover, on the display unit 13, such a design confirmation screen as shown in FIG. 12 is displayed.

The design confirmation screen is a screen that superimposes and displays the nail design D, which is designated (selected) by the user, on the image showing the nail T displayed on the post-shape adjustment shape confirmation screen, the nail T already having the shape adjustment-required region Fa filed off therefrom.

The nail design D is superimposed and displayed on the image showing the nail T already subjected to the shape adjustment, whereby it becomes easy for the user to confirm whether or not a balance between the shape, length and the like of the nail T already subjected to the shape adjustment and the desired nail design D is appropriate in the case where the nail design D concerned is printed.

Figure 13:
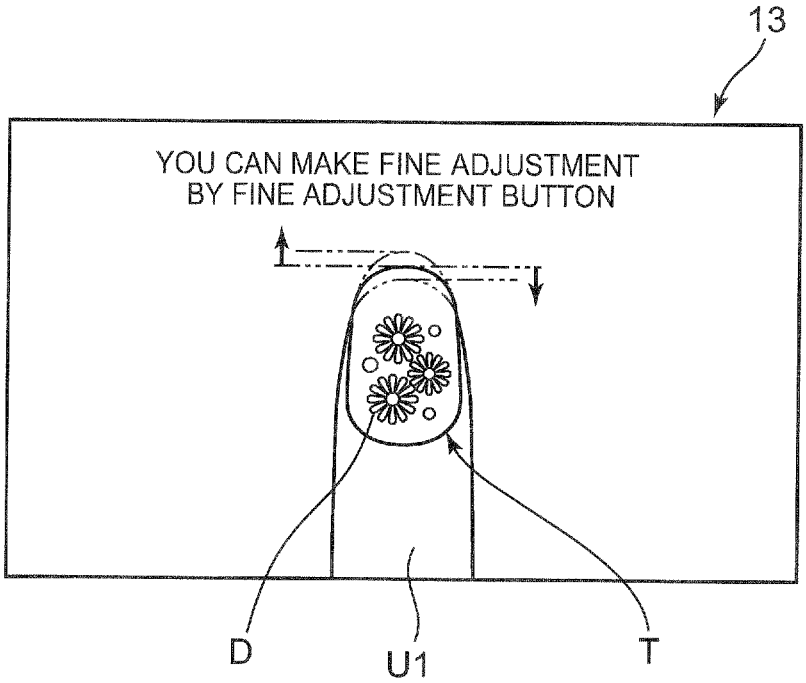
FIG. 13 is a view showing an example of a case of performing adjustment in a longitudinal direction on a shape adjustment-required region fine adjustment screen.
Figure 14:
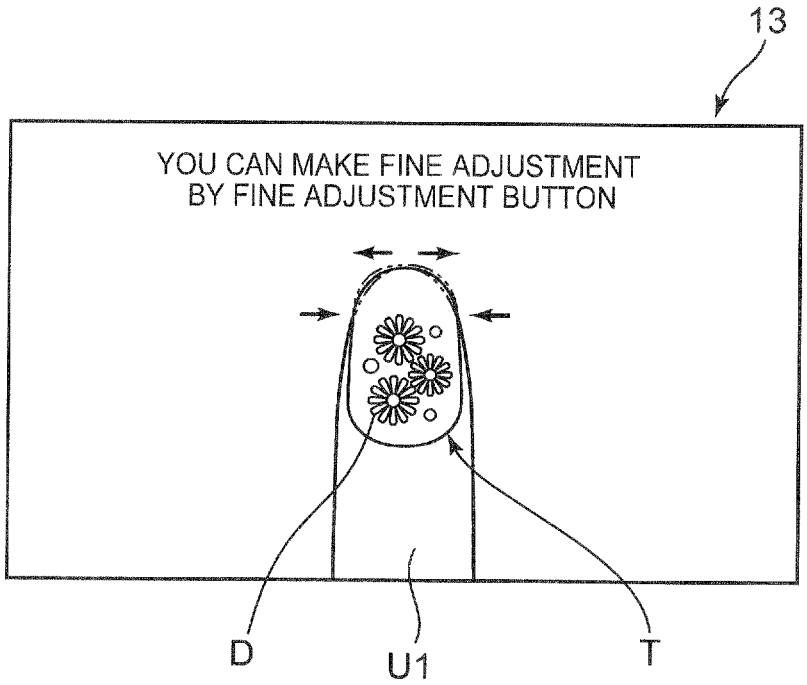
FIG. 14 is a view showing an example of a case of performing adjustment in a lateral direction on the shape adjustment-required region fine adjustment screen.

Moreover, on the display unit 13, such a shape adjustment-required region fine adjustment screen as shown in FIG. 13 and FIG. 14 is displayed.

The shape adjustment-required region fine adjustment screen is a screen in which a comment saying "you can make fine adjustment by fine adjustment buttons" is displayed on the image showing the nail T displayed on the post-shape adjustment shape confirmation screen, the nail T already having the shape adjustment-required region Fa filed off therefrom, or on the image displayed on the design confirmation screen, the image already having the nail design D superimposed thereon.

The user appropriately operates the fine adjustment buttons 122 (122*a* to 122*d*) as mentioned above in a state where this shape adjustment-required region fine adjustment screen is displayed on the display unit 13, and can thereby finely adjust the longitudinal and lateral dimensions of the shape adjustment-required region Fa (refer to FIG. 13 and FIG. 14).

For example, in the case where the following length is desired to be increased, which is a longitudinal length of each nail tip region Np already subjected to the shape adjustment, that is, a length dimension L from a free edge E as an end edge on a nail bed Uf side of the nail tip region Np in FIG. 9 to a tip end portion of the nail T therein, then the user operates the longitudinal direction extending button 122*a* in the fine adjustment buttons 122 in a state where the shape adjustment-required region fine adjustment screen is displayed, and adjusts the length dimension L to a desired length. On the contrary, in the case where the length dimension L from the free edge E as the end edge on the nail bed Uf side of the nail tip region Np to the tip end portion of the nail T is desired to be reduced, then the user operates the longitudinal direction contracting button 122*b*, and adjusts the length dimension L to a desired length. When the length dimension L is increased, the longitudinal dimension of the shape adjustment-required region Fa becomes small by this amount, and when the length dimension L is reduced, the longitudinal dimension of the shape adjustment-required region Fa becomes large by this amount.

Moreover, when the lateral direction contracting button 122*c* or the lateral direction extending button 122*d* is operated, a width of the shape adjustment-required region Fa can be adjusted. Specifically, the lateral direction contracting button 122*c* is operated, whereby a tip end portion of the shape adjustment-required region Fa becomes slender, and the lateral direction extending button 122*d* is operated, whereby the tip end portion of the shape adjustment-required region Fa is adjusted to a flat and wide shape.

In this embodiment, the four fine adjustment buttons (longitudinal direction extending button 122*a*, longitudinal direction contracting button 122*b*, lateral direction contracting button 122*c*, lateral direction extending button 122*d*) are operated, whereby it is made possible to adjust the longitudinal/lateral dimensions of the shape adjustment-required region Fa for each of the printing fingers U1.

Note that, when the user operates the filing printing start button 124 in a state where the post-shape adjustment shape confirmation screen, the design confirmation screen and the shape adjustment-required region fin adjustment screen are displayed on the display unit 13, the shape adjustment-required region Fa is decided in a state of being displayed on the display screen of the display unit 13, and the filing printing of coloring with red or the like is performed for the shape adjustment-required region Fa thus determined.

Note that, in the case where the touch panel is composed integrally on the surface of the display unit 13, then an operation button such as an OK button may be displayed on the screen concerned, and just by an action of the user to touch the operation button, the shape adjustment-required region Fa may be determined, and the filing printing may be started.

Moreover, for example, the control device 50 is installed on the board 31 arranged in the upper machine casing 11*b*, and the like. FIG. 6 is a main portion block diagram showing a control configuration in this embodiment.

As shown in FIG. 6, the control device 50 is a computer including: the control unit 51 composed of a central processing unit (CPU, not shown) and the like; a read only memory (ROM) 52 as a storage unit; a random access memory (RAM) 53 as a storage unit; and the like. Note that the storage units are not limited to the ROM 52 and the RAM 53 in the control device 50, and other storage units may be provided.

From a functional viewpoint, this control unit 51 includes a nail region image extraction unit 511, the nail tip region extraction unit 512, the shape adjustment-required region extraction unit 513, the printing control unit 514, a display control unit 515, and the like. Functions as the nail region image extraction unit 511, the nail tip region extraction unit 512, the shape adjustment-required region extraction unit 513, the printing control unit 514, the display control unit 515, and the like are realized by cooperation between the CPU and a program stored in the ROM 52.

The nail region image extraction unit 511 is a nail region image extraction unit that extracts, from the fingernail image obtained by the pick-up unit 30 as the fingernail image obtaining unit, the nail region image of the nail T, which is contained therein.

For example, the nail region image extraction unit 511 is a unit that extracts the nail region image (outline of the nail T) from the fingernail image, which is obtained by the pick-up unit 30, based on a color difference between the nail T and other finger portion. Note that a method for extracting the nail region image by the nail region image extraction unit 511 is not particularly limited, and is not limited to that mentioned here.

The nail tip region extraction unit 512 is a nail tip region extraction unit that extracts the nail tip region Np of the nail T from the nail region image of the nail T, which is extracted by the nail region image extraction unit 511.

Here, the nail tip region Np (that is, a "free edge region") refers to a region extended outward from the nail bed Uf as a skin portion under the nail in the finger. That is to say, the nail tip region Np is a region of the nail T, which is not adhered to the skin portion (nail bed Uf) of the finger, and with regard to the nail T, only the nail tip region Np among the whole of the region thereof can be filed off and subjected to the shape adjustment (filing) by the file and the like.

In general, in the nail T, the nail tip region Np is whitish, and a portion thereof in contact with the skin portion (nail bed Uf) of the finger is reddish. For example, in the nail region image obtained by the pick-up unit 30, the nail tip region extraction unit 512 identifies such a color difference between the portions of the nail T, and so on, thereby extracting the nail tip region Np.

Note that a method for extracting the nail tip region Np by the nail tip region extraction unit 512 is not particularly limited, and is not limited to that mentioned here.

The shape adjustment-required region extraction unit 513 is a shape adjustment-required region extraction unit that positionally aligns the model nail image M with the nail region image of the nail T, which is obtained by the pick-up unit 30, and extracts, as the shape adjustment-required region Fa, a region located outward from the outline of the model nail image M in the nail tip region Np extracted by the nail tip region extraction unit 512.

In this embodiment, the shape adjustment-required region extraction unit 513 positionally aligns the model nail image M, which is designated by operating the setting button 121 as the nail shape designation unit in the operation unit 12, with the nail region image of the user, thereby extracting the shape adjustment-required region Fa.

The printing control unit 514 is a printing control unit that controls the printing unit 40 to print, on the nail T of the user, the image clearly showing the shape adjustment-required region Fa extracted by the shape adjustment-required region extraction unit 513.

In this embodiment, the printing control unit 514 controls the printing unit 40 to print, as the image clearly showing the shape adjustment-required region Fa, an image in which the whole of the region extracted as the shape adjustment-required region Fa is colored with a predetermined color (for example, red).

Note that, besides the image clearly showing the shape adjustment-required region Fa, the printing control unit 514 controls the printing unit 40 to print an image of the nail design D or the like on the nail T in the usual printing.

The display control unit 515 is a display control unit that controls a display unit 26 to display a variety of displays. In this embodiment, besides the variety of designation screens as mentioned above, the display control unit 515 controls the display unit 26 to display, on the display unit 13, the nail shape designation screen, the design designation screen, the shape adjustment-required region confirmation screen, the post-shape adjustment shape confirmation screen, the design confirmation screen, the shape adjustment-required region fine adjustment screen, and the like.

Moreover, the ROM 52 as the storage unit stores a variety of programs such as: a nail region image extraction program for extracting the nail region image from the fingernail image; a nail tip region extraction program for extracting the nail tip region Np from the nail region image; a shape adjustment-required region extraction program for positionally aligning the model nail image M with the nail region image, and extracting, as the shape adjustment-required region Fa, the region located outward from the outline of the model nail image M in the nail tip region Np extracted by the nail tip region extraction unit; a printing processing program for performing printing processing; and a display processing program for performing display processing. These programs are executed by the control device 50, whereby the respective units of the nail printing device 1 are controlled in a centralized manner.

Furthermore, in this embodiment, the ROM 52 stores data of the outlines of the nail shapes capable of being designated as the model nail image M, and the like (in this embodiment, the outlines are outlines of five types of the nail tip shapes, which are point, oval, round, square-off and square, and the like).

Moreover, the RAM 53 as the storage unit in this embodiment includes: a storage area (not shown) that stores a variety of data; and a work area (not shown) that expands the programs and the like in the event of performing a variety of processing.

In the storage area of the RAM 53, there are stored the variety of data, for example, such as: data of the fingernail image obtained by the pick-up unit 30; data of the model nail image M and image data of the nail design D, which are designated in such a manner that the user operates the setting button 121; data of the nail region image extracted by the nail region image extraction unit 511; data of the nail tip region Np extracted by the nail tip region extraction unit 512; and data of the shape adjustment-required region Fa extracted by the shape adjustment-required region extraction unit 513.

Next, while referring to FIG. 7 and FIG. 8 to FIGS. 15A and 15B, a description is made of a printing control method by the nail printing device 1 in this embodiment.

In the case of performing the printing by the nail printing device 1, first, the user turns on a power supply switch and activates the control device 50.

The display control unit 515 displays the nail shape designation screen (refer to FIG. 8) on the display unit 13, and the user operates the setting button 121 of the operation unit, and so on, thereby designating the desired model nail image M from among the plurality of model nail images M.

Figure 7:
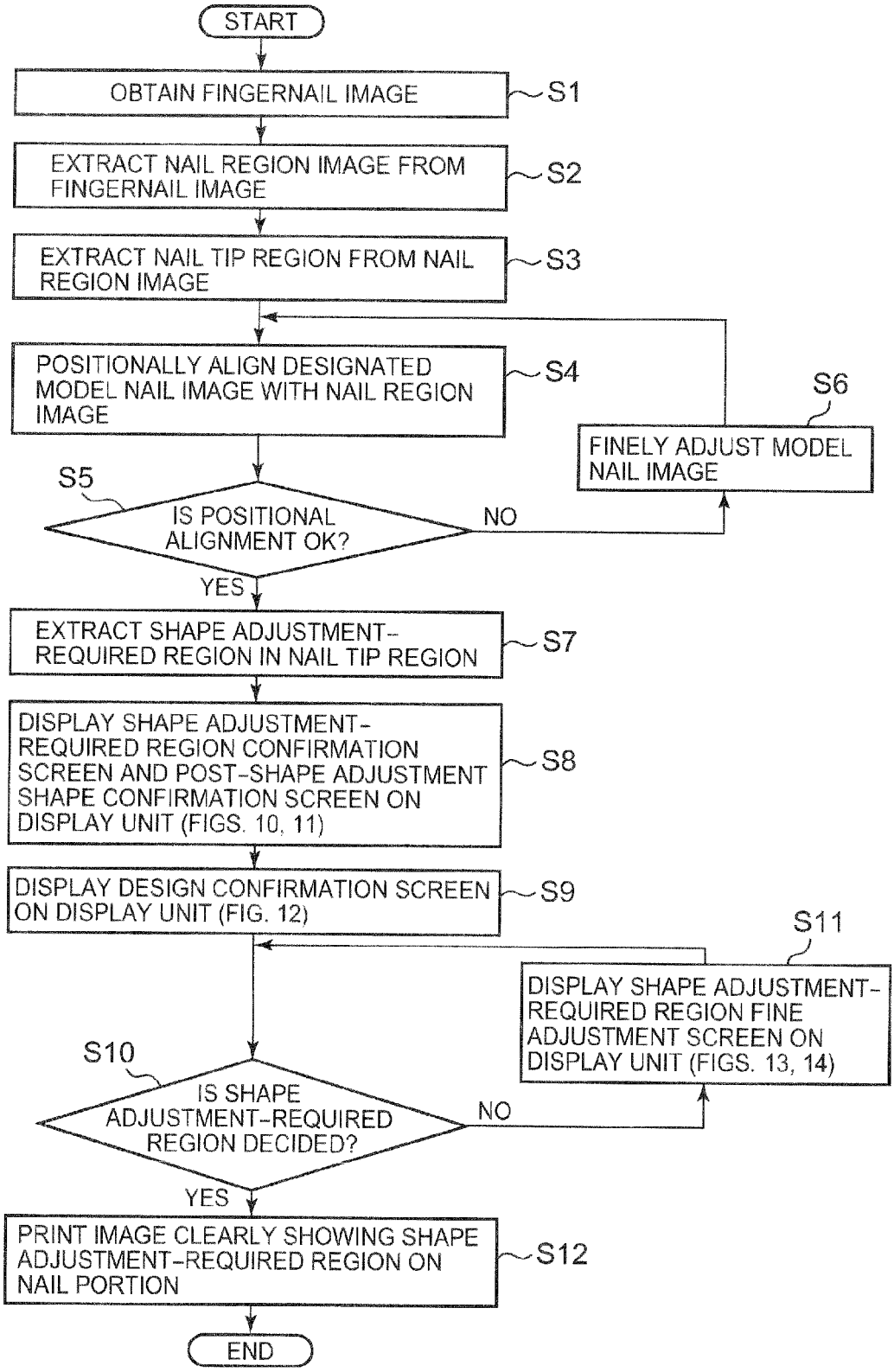
FIG. 7 is a flowchart showing printing control processing in a first embodiment.

When each of the printing fingers U1 of the user is inserted into the printing finger insertion portion 20*a*, first, as shown in FIG. 7, the fingernail image of the user is obtained by the pick-up unit 30 (Step S1). Then, the nail region image extraction unit 511 extracts the nail region image from the obtained fingernail image (Step S2), and further, the nail tip region extraction unit 512 extracts the nail tip region Np from the nail region image (Step S3).

The shape adjustment-required region extraction unit 513 positionally aligns the model nail image M, which is designated by the user, with the nail region image of the nail T of the user (Step S4). The shape adjustment-required region extraction unit 513 always determines whether or not the positional alignment is completed, that is, whether or not such an operation of positionally aligning the designated model nail image M with the nail region image of the nail T of the user while matching sizes of both thereof with each other is ended (Step S5). In the case where the positional alignment is not completed (that is, the sizes and the like shift between both) (Step S5: NO), the designated model nail image M is finely adjusted (Step S6), and pieces of the processing of Steps S4 and S5 are repeated.

On the other hand, in the case where the positional alignment of both of the above is completed (that is, the sizes and the like do not shift between both (Step S5: YES) (Step S5: YES), the shape adjustment-required region extraction unit 513 extracts, as the shape adjustment-required region Fa, the region located outward from the outline of the designated model nail image M in the nail tip region Np of the nail T (Step S7).

When the shape adjustment-required region Fa is extracted, then on the display screen of the display unit 13, there are displayed: the shape adjustment-required region confirmation screen (refer to FIG. 10) in which the shape adjustment-required region Fa is colored with a conspicuous color such as red; and the post-shape adjustment shape confirmation screen (refer to FIG. 11) that shows into which shape the shape adjustment-required region Fa is formed in the case of being filed by the file and the like (Step S8). Moreover, in the case where the nail design D desired to be printed on the nail T is designated by the user, the design confirmation screen (refer to FIG. 12) in which the designated nail design D is superimposed on the shape of the nail T already subjected to the shape treatment is displayed (Step S9). In this embodiment, an example where the nail design D with the flower pattern is designated by the user is shown, and as shown in FIG. 12, an image in which the nail design D with the flower pattern is superimposed on the nail T of the user already subjected to the shape adjustment is displayed on the display unit 13 together with a comment saying "is this design OK for printing?".

The control unit 51 always determines whether or not the shape adjustment-required region Fa is decided in such a manner that the user operates the OK button (not shown) and the like (Step S10). In the case where it is determined that the shape adjustment-required region Fa is decided (Step S10: YES), the printing control unit 514 controls the printing unit 40, and the printing of a predetermined color such as red is performed on the region extracted as the shape adjustment-required region Fa (Step S12).

On the other hand, in the case where it is determined that the shape adjustment-required region Fa is not decided (Step S10: NO), the shape adjustment-required region fine adjustment screen (refer to FIG. 13 and FIG. 14) is displayed on the display unit 13 (Step S11). The user operates the fine adjustment buttons 122 (the longitudinal direction extending button 122*a*, the longitudinal direction contracting button 122*b*, the lateral direction contracting button 122*c*, and the lateral direction extending button 122*d*), thereby adjusting the longitudinal length and lateral width of the shape adjustment-required region Fa while confirming the shape adjustment-required region fine adjustment screen. The control unit 51 always determines whether or not the shape adjustment-required region Fa is decided in such a manner that the user operates the OK button (not shown) and the like (Step S10). In the case where it is determined that the shape adjustment-required region Fa is decided (Step S10: YES), the printing control unit 514 controls the printing unit 40, and the printing of a predetermined color such as red is performed on the region extracted as the shape adjustment-required region Fa (Step S12).

Note that the description has been made here of the case of coping with one printing finger U1; however, in the case of simultaneously performing the printing processing, for example, for the plurality of printing fingers U1 such as four fingers as in this embodiment, the printing processing described above is repeated for each of the printing fingers U1, whereby the printing processing is performed for all of the printing fingers U1.

After the printing, as shown in FIG. 15A, the user performs the shape adjustment (filing) operation of filing, by the file 9, the shape adjustment-required region Fa printed with red or the like on each nail T until the color thus printed becomes invisible. When the shape adjustment-required region Fa colored by the printing is entirely filed off, then as shown in FIG. 15B, the nail T of the user's own is subjected to the shape adjustment (filing) into a desired nail tip shape.

Figure 16B:
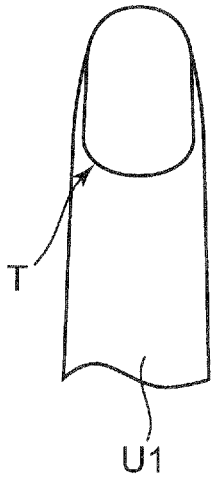
FIG. 16B is a view showing a state after the shape adjustment.

Note that, also in the case where not all of the shape adjustment-required region Fa is colored but the printing by a predetermined color is implemented for the boundary line between the shape adjustment-required region Fa and the other nail region, then as shown in FIG. 16A, the user performs the shape adjustment (filing) operation of filing, by the file 9, the shape adjustment-required region Fa until the boundary line printed with red or the like on each nail T becomes invisible. When the nail T is filed off to the boundary line colored by the printing, then as shown in FIG. 16B, the nail T of the user's own is subjected to the shape adjustment (filing) into the desired nail tip shape.

As described above, in accordance with the nail printing device 1 in this embodiment, the model nail image M is positionally aligned with the nail region image of the nail T, and the region located outward from the outline of the model nail image M in the nail tip region Np of the nail T is extracted as the shape adjustment-required region Fa, and the image (refer to the shape adjustment-required region confirmation screen of FIG. 10) clearly showing the extracted shape adjustment-required region Fa is displayed on the display screen.

In such a way, where and to which extent the nail should be filed in order to perform the shape adjustment (filing) therefor to the model nail image M can be confirmed before the shape adjustment (filing).

Moreover, the model nail image M can be appropriately re-designated by seeing the shape (refer to the post-shape adjustment shape confirmation screen of FIG. 11) of the nail T already subjected to the shape adjustment (filing), the shape being displayed on the display unit 13, the image (refer to the design confirmation screen of FIG. 12) in which the nail design D is superimposed on the nail T already subjected to the shape adjustment, the image being displayed on the display unit 13, and the like.

Furthermore, the user him/herself can also finely adjust the longitudinal length and lateral width of the shape adjustment-required region Fa as appropriate while confirming the shape adjustment-required region fine adjustment screen, and can thereby adjust the shape adjustment-required region Fa so that the nail T can have the desired shape.

Then, in the case where the shape adjustment required region Fa displayed on the display unit 13 is acceptable, the printing is performed with a predetermined conspicuous color such as red for the whole of the region extracted as the shape adjustment-required region Fa on the nail T. In such a way, even a user who is not accustomed to the shape adjustment (filing) of the nail T can easily determine the region to be subjected to the shape adjustment (filing) by the file and the like, and can easily adjust the nail T to the desired shape (refer to FIG. 15A and FIG. 15B). Moreover, the same is also applied to the case where the printing is implemented with a predetermined color for the boundary line between the shape adjustment-required region Fa and the other nail region (refer to FIG. 16A and FIG. 16B).

Second Embodiment

Figure 17:
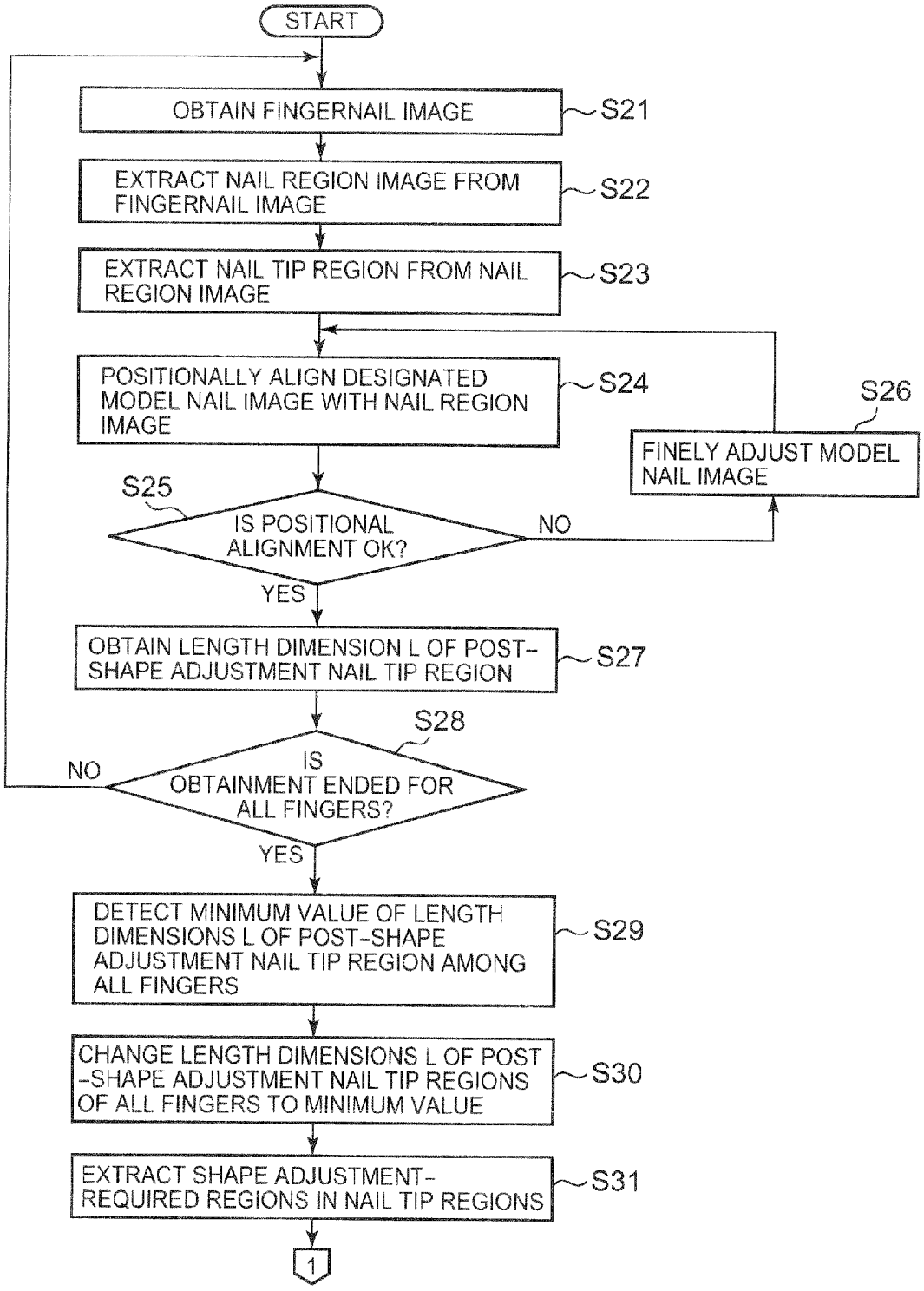
FIG. 17 is a flowchart showing printing control processing in a second embodiment.
Figure 18:
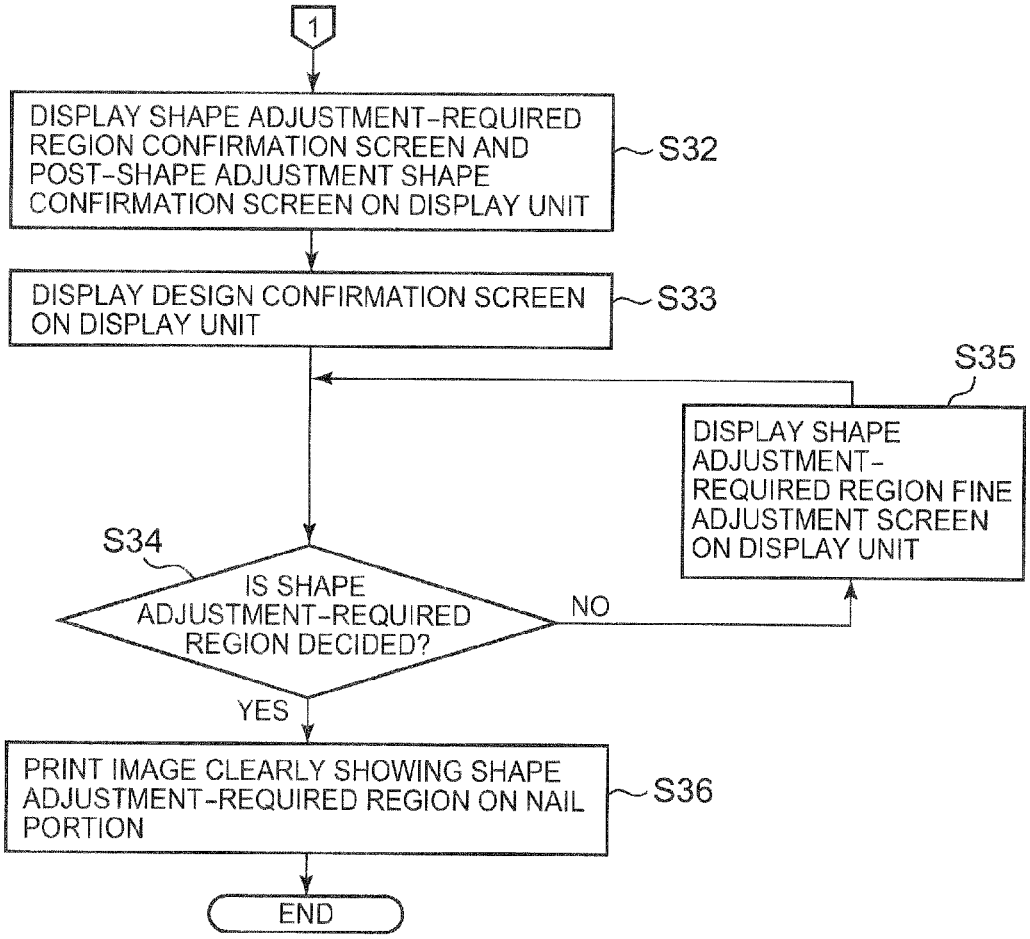
FIG. 18 is a flowchart showing the printing control processing in the second embodiment.
Figure 19:
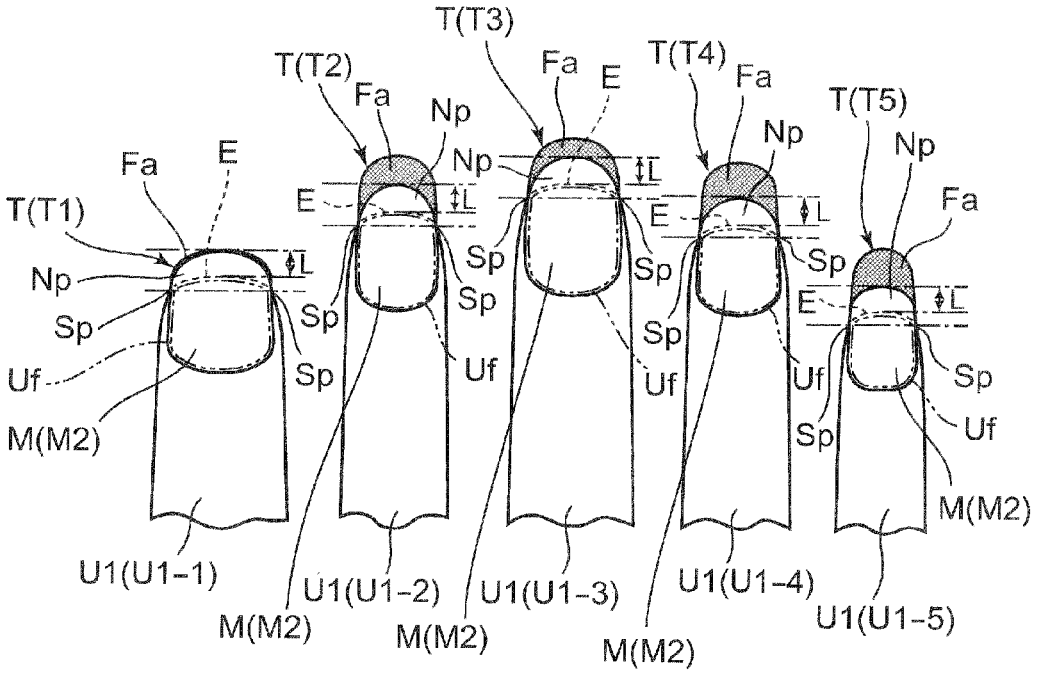
FIG. 19 is an explanatory view showing positional relationships between nail tip regions and shape adjustment-required regions in nails in the second embodiment.

Next, while referring to FIG. 17 to FIG. 19, a description is made of a second embodiment of the nail printing device according to the present invention. Note that this embodiment is different from the first embodiment in a way of extraction of the shape adjustment-required region Fa by the shape adjustment-required region extraction unit, and accordingly, in the following, a description is particularly made of points where this embodiment is different from the first embodiment.

A device configuration of the nail printing device in this embodiment is similar to that described in the first embodiment, and accordingly, a description thereof is omitted.

In this embodiment, the pick-up unit 30 as the fingernail image obtaining unit is a unit that picks up a plurality of fingers, for example, such as five fingers which are the thumb to the little finger in one hand, and obtains fingernail images containing nail region images of the respective nails corresponding to the fingers concerned.

Moreover, the nail region image extraction unit 511 extracts the nail region images from the obtained fingernail images of the respective fingers, and the nail tip region extraction unit 512 extracts nail tip regions Np individually from the nail region images extracted from the respective fingernail images.

Note that a method in which the nail region image extraction unit 511 extracts the nail region images from the fingernail images and a method in which the nail tip region extraction unit 512 extracts the nail tip regions Np from the nail region images extracted from the fingernail images are similar to those described in the first embodiment, and accordingly, a description thereof is omitted.

In this embodiment, the pick-up unit 30 as the fingernail image obtaining unit is the unit that picks up the plurality of printing fingers U1 and obtains the fingernail images containing the nail region images of the respective nails T corresponding to the printing fingers U1 concerned. The shape adjustment-required region extraction unit 513 is a unit that extracts the shape adjustment-required regions Fa from the respective nail region images extracted from the fingernail images of the respective nails T of the plurality of printing fingers U1. In the event of extracting the shape adjustment-required regions Fa, the shape adjustment-required regions Fa are extracted so that length dimensions from free edges E as end edges on a nail bed Uf side of the nail tip regions Np to tip end portions of the nails T of the plurality of printing fingers U1 can become equal among the respective nails T.

That is to say, the shape adjustment-required region extraction unit 513 positionally aligns the model nail images M, which are designated by the user, individually with the plurality of nail region images prepared individually for the respective fingers, and then individually extracts the shape adjustment-required regions Fa from the nail tip regions of the respective fingers. Then, the length dimensions L (refer to FIG. 19) of the nail tip regions Np which have been already subjected to the shape adjustment, that is, from which the extracted shape adjustment-required regions have been already filed off, are obtained, and the length dimensions L of the nail tip regions Np already subjected to the shape adjustment are compared among all of the fingers. As a result, in the case where there are variations among the length dimensions L of the nail tip regions Np already subjected to the shape adjustment, then a minimum value of the length dimensions L is detected, and also with regard to other fingers of which length dimensions L are not the minimum, lengths of such post-shape adjustment nail tip regions Np thereof are changed so that the length dimensions L of the post-shape adjustment nail tip regions Np can become the same as this minimum value, and the shape adjustment-required regions Fa in the nail tip regions Np are extracted so that this condition can be satisfied.

In such a way, as shown in FIG. 19, with regard to all of the printing fingers U1, the length dimensions L from the free edges E as the end edges on the nail bed Uf side of the nail tip regions Np already subjected to the shape adjustment (filing) to the tip end portions of the nails T become equal to one another.

For example, in an example shown in FIG. 19, in the case where the thumb U1-1 to the little finger U1-5 which are the printing fingers U1 are compared with one another, the length of the nail T1 of the thumb U1-1 is the shortest, and accordingly, also with regard to the length dimensions L from the free edges E to the tip end portions of the nails T after the shape adjustment, the length dimension L of the thumb U1-1 becomes the smallest.

Therefore, as shown in FIG. 19, with regard to the forefinger U1-2 to the little finger U1-5 which are other than the thumb U1-1, the lengths of the nail tip regions Np thereof are changed so that the length dimensions L from the free edges E to the tip end portions of the nails T after the shape adjustment can become substantially the same as the length dimension L in the thumb U1-1, and the shape adjustment-required regions Fa in the nail tip regions Np are extracted so that this condition can be satisfied.

Note that, since other configurations are similar to those described in the first embodiment, a description thereof is omitted.

Next, while referring to FIG. 17 to FIG. 19, a description is made of a printing control method of the nail printing device in this embodiment.

In a similar way to the first embodiment, also in this embodiment, the user refers to the nail shape designation screen (refer to FIG. 8) displayed on the display unit, and designates the desired model nail image M and the nail design D desired to be printed.

When each of the printing fingers U1 of the user is inserted into the printing finger insertion portion 20*a*, first, as shown in FIG. 17, the fingernail image of the user is obtained by the pick-up unit 30 (Step S21). Then, the nail region image is extracted from this fingernail image (Step S22), and further, the nail tip region Np is extracted from the nail region image (Step S23). The shape adjustment-required region extraction unit 513 positionally aligns the model nail image M, which is designated by the user, with the nail region image of the nail T of the user (Step S24), and always determines whether or not the positional alignment is completed (Step S25). In the case where the positional alignment is not completed (Step S25: NO), the designated model nail image M is finely adjusted (Step S26), and pieces of the processing of Steps S24 and S25 are repeated.

On the other hand, in the case where the positional alignment of both of the above is completed (Step S25: YES), the shape adjustment-required region extraction unit 513 obtains the length dimension L of the nail tip region Np which has been already subjected to the shape adjustment, that is, from which the shape adjustment-required region Fa has been already filed off (Step S27). Then, in the case where the operation is performed for all of the printing fingers U1, that is, for one hand, then the following determination is performed for five fingers which are the thumb U1-1 to the little finger U1-5 in one hand, and in the case where the operation is performed for all of the printing fingers in both hands, then the following determination is performed for ten fingers which are the thumbs U1-1 to the little fingers U1-5 of the right and left hands. Here, the determination is made as to whether or not the length dimensions L of the nail tip regions Np, which are to be obtained after the shape adjustment, are obtained (Step S28). If the length dimensions L are not obtained (Step S28: NO), then the processing from Step S21 to Step S27 is repeated for the printing fingers U1 for which the length dimensions L are not obtained.

In the case where the length dimensions L of the post-shape adjustment nail tip regions Np are obtained for all of the printing fingers U1 (Step S28: YES), then the shape adjustment-required region extraction unit 513 detects the minimum value of the obtained length dimensions L (Step S29). Then, for all of the printing fingers U1, the length dimensions L of the post-shape adjustment nail tip regions Np are changed so as to become this minimum value (Step S30), and the shape adjustment-required regions Fa in the nail tip regions Np are extracted so that this condition can be satisfied (Step S31).

Note that Step S32 to Step S36, which are shown in FIG. 18, are similar to Step S8 to Step S12 (refer to FIG. 7), which are described in the first embodiment, and accordingly, a description thereof is omitted.

Moreover, other pieces of the processing are similar to those of the first embodiment, and accordingly, a description thereof is omitted.

In such a way, as shown in FIG. 19, the shape adjustment-required regions Fa are extracted from the nails T of the respective printing fingers U1 so that the length dimensions L of the post-shape adjustment nail tip regions Np can become substantially equal to one another in all of the printing fingers U1. Then, after the printing, the user files off, by the file and the like, the regions printed as the shape adjustment-required regions Fa with a predetermined color such as red on the nails T, and can thereby turn the nails T of all of the printing fingers U1 to a state where the lengths of the nail tip regions Np are equalized to one another.

As described above, in a similar way to the first embodiment, in accordance with the nail printing device in this embodiment, the model nail images M are positionally aligned with the nail region images of the nails T, and the regions located outward from the outlines of the model nail images M in the nail tip regions Np of the nails T are extracted as the shape adjustment-required regions Fa. At this time, in this embodiment, the shape adjustment-required region extraction unit 513 extracts the shape adjustment-required regions Fa from the nails T of the plurality of printing fingers U1 so that all of the length dimensions L of the post-shape adjustment nail tip regions Np can become substantially equal to one another in the respective printing fingers U1 (refer to FIG. 19). Therefore, for all of the printing fingers U1, the length dimensions L of the post-shape adjustment nail tip regions Np are equalized to one another, and the post-shape adjustment nail tip regions Np can be turned to a balanced state.

Then, an image (refer to the shape adjustment-required region confirmation screen of FIG. 10) clearly showing the shape adjustment-required regions Fa thus extracted is displayed on the display screen. In such a way, where and to which extent the nail should be filed in order to perform the shape adjustment therefor to the model nail images M can be confirmed before the shape adjustment.

Moreover, when the shape adjustment-required regions Fa are decided, the printing with a predetermined color is implemented for the whole of the regions extracted as the shape adjustment-required regions Fa on the corresponding nails T. In such a way, even the user who is not accustomed to the shape adjustment of the nails can easily determine the regions to be subjected to the shape adjustment (filing) by the file and the like, and can easily adjust the nails T to the desired shapes. Moreover, the same is also applied to the case where the printing is implemented with a predetermined color for the boundary lines between the shape adjustment-required regions Fa and the other nail regions.

Then, as mentioned above, in the event where the shape adjustment-required region extraction unit 513 extracts the shape adjustment-required regions Fa, for all of the fingers, the shape adjustment-required regions Fa are extracted from the nails T of the respective fingers so that the length dimensions L of the post-shape adjustment nail tip regions Np can become substantially equal to one another. Accordingly, when the shape adjustment (filing) is performed so as to file off the shape adjustment-required regions Fa after the image clearly showing the same shape adjustment-required regions Fa is printed, the nails T of all of the fingers can be turned to a state where the lengths of the nail tip regions Np are equalized to one another. For all of the fingers, well-balanced shape adjustment (filing) can be easily performed.

Third Embodiment

Figure 20:
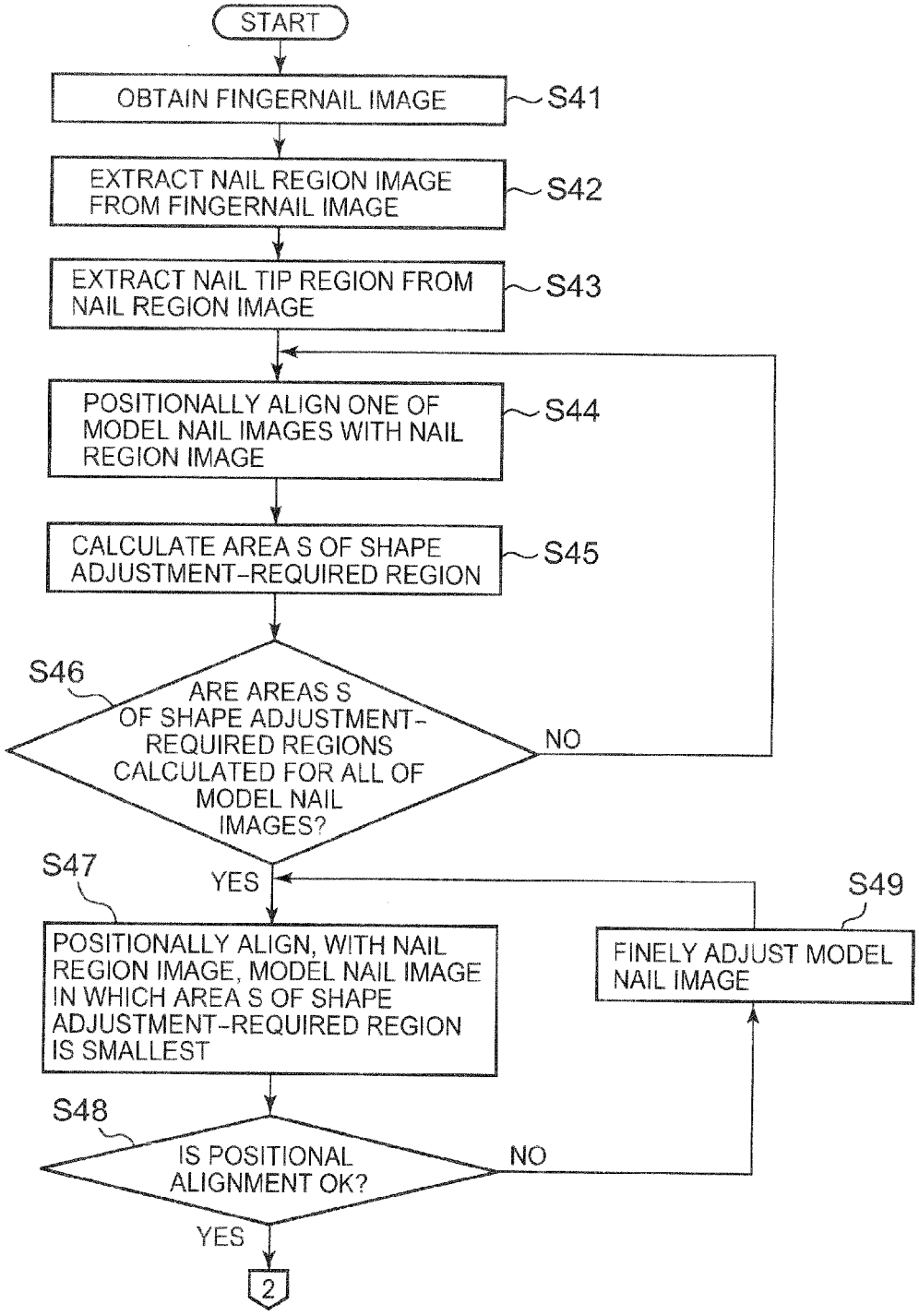
FIG. 20 is a flowchart showing printing control processing in a third embodiment.
Figure 21:
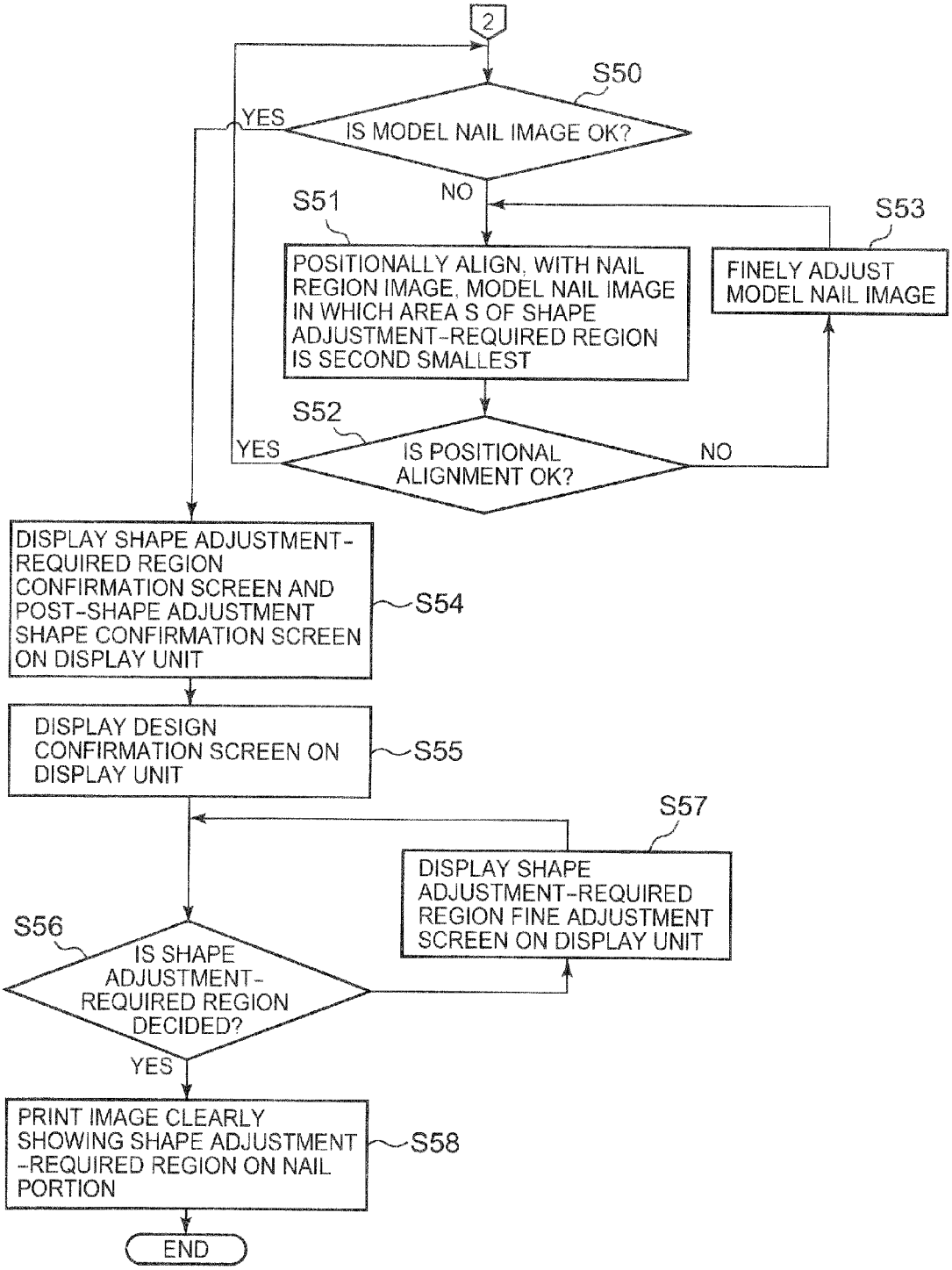
FIG. 21 is a flowchart showing the printing control processing in the third embodiment.

Next, while referring to FIG. 20 and FIG. 21, a description is made of a third embodiment of the nail printing device according to the present invention. Note that this embodiment is different from the first embodiment and the second embodiment in the way of extraction of the shape adjustment-required region Fa by the shape adjustment-required region extraction unit, and accordingly, in the following, a description is particularly made of points where this embodiment is different from the first embodiment and the second embodiment.

A device configuration of the nail printing device in this embodiment is similar to those described in the first embodiment and the second embodiment, and accordingly, a description thereof is omitted.

In this embodiment, the designation of the model nail image M is automatically performed by the shape adjustment-required region extraction unit 513 of the control device 50, and the shape adjustment-required region extraction unit 513 functions as the nail shape designation unit that designates one model nail image M from among the plurality of model nail images M.

Specifically, when the nail region image is extracted from the fingernail image obtained for the finger of the user, the shape adjustment-required region extraction unit 513 selects any one from among the plurality of model nail images M stored in the ROM 52, and positionally aligns the selected model nail image M with the nail region image. Then, the shape adjustment-required region extraction unit 513 extracts the shape adjustment-required region Fa, and calculates an area S thereof. In the case where a plurality of the model nail images M are present, then for all of the model nail images M concerned, the shape adjustment-required region extraction unit 513 performs the positional alignment with the nail region images, the extraction of the shape adjustment-required regions Fa, and the calculation of the areas S of the shape adjustment-required regions Fa.

Then, the shape adjustment-required region extraction unit 513 positionally aligns a model nail image M, in which the area S of the shape adjustment-required region Fa becomes the smallest among all of the model nail images M, with the nail region image.

An image in which the model nail image M is positionally aligned with the nail region image is displayed on the display unit 13. In the case where the model nail image M concerned is acceptable, the user operates the operation unit 12 and the like, thereby deciding to apply the model nail image M concerned. Then, the user confirms such a post-shape adjustment image on the shape adjustment-required region confirmation screen, the design confirmation screen and the like, finely adjusts the image as appropriate according to needs, and then decides the shape adjustment-required region Fa.

Moreover, in the case where the user does not desire to apply the model nail image M designated as a result that the area S of the shape adjustment-required region Fa is determined to be the smallest, the shape adjustment-required region extraction unit 513 positionally aligns a model nail image, in which the area S of the shape adjustment-required region Fa is the second smallest, with the nail region image, displays an image concerned on the display unit 13, and proposes the image to the user.

As described above, the model nail images M are sequentially proposed to the user in order from the smaller area S of the shape adjustment-required region Fa, whereby the shape adjustment-required region Fa can be set so that the area to be subjected to the shape adjustment (filing) by being filed by the file, and so on can be saved to be as small as possible.

Note that, since other configurations are similar to those described in the first embodiment and the second embodiment, a description thereof is omitted.

Next, while referring to FIG. 20 to FIG. 21, a description is made of a printing control method of the nail printing device in this embodiment.

When the printing finger U1 of the user is inserted into the printing finger insertion portion 20*a*, first, as shown in FIG. 20, the fingernail image of the user is obtained by the pick-up unit 30 (Step S41). Then, the nail region image is extracted from this fingernail image (Step S42), and further, the nail tip region Np is extracted from the nail region image (Step S43). The shape adjustment-required region extraction unit 513 positionally aligns the one of the plurality of model nail images M with the nail region image of the nail T of the user (Step S44), and calculates the area S of the shape adjustment-required region Fa for which the shape adjustment is required in this case (Step S45).

The shape adjustment-required region extraction unit 513 always determines whether or not, for all of the model nail images M, the positional alignment with the nail region image and the calculation of the area S of the shape adjustment-required region Fa are completed (Step S46). In the case where the calculation of the area S of the shape adjustment-required region Fa is not completed for all of the model nail images M (Step S46: NO), pieces of the processing of Step S44 and S45 are repeated for the model nail images M for which the calculation of the area S of the shape adjustment-required region Fa is not completed yet.

On the other hand, in the case where the calculation of the area S of the shape adjustment-required region Fa is completed for all of the model nail images M (Step S46: YES), the model nail image M in which the area S of the shape adjustment-required region Fa is the smallest is positionally aligned with the nail region image of the user (Step S47).

The shape adjustment-required region extraction unit 513 always determines whether or not the positional alignment is completed (Step S48). In the case where the positional alignment is not completed (Step S48: NO), the designated model nail image M is finely adjusted (Step S49), and pieces of the processing of Steps S47 and S48 are repeated.

On the other hand, in the case where the positional alignment of both is completed (Step S48: YES), the image in which the model nail image M is positionally aligned with the nail region image, and the shape and the like of the nail T already subjected to the shape adjustment are displayed on the display unit 13. The user confirms the displayed image, shape and the like. In the case where the model nail image M concerned is acceptable, the user operates the operation unit 12 and the like, and decides to apply the model nail image M concerned.

The shape adjustment-required region extraction unit 513 always determines whether or not the application of the model nail image M is decided (Step S50). In the case where the application of the model nail image M concerned is not decided (Step S50: NO), similar pieces of processing to those of Step S47 to Step S49 are repeated for the model nail image M in which the area S of the shape adjustment-required region Fa is the second smallest (Step S51 to Step S53).

On the other hand, in the case where the application of the model nail image M concerned is decided (Step S50: YES), similar pieces of processing to those of Step S8 to Step S12, which are described in the first embodiment, are performed (Step S54 to Step S58).

Note that, since other pieces of the processing are similar to those described in the first embodiment and the second embodiment, a description thereof is omitted.

As described above, in a similar way to the first embodiment and the second embodiment, in accordance with the nail printing device in this embodiment, the model nail image M is positionally aligned with the nail region image of the nail T, and the region located outward from the outline of the model nail image M in the nail tip region Np of the nail T is extracted as the shape adjustment-required region Fa, and the image (refer to the shape adjustment-required region confirmation screen of FIG. 10) clearly showing the shape adjustment-required region Fa thus extracted is displayed on the display screen.

In such a way, where and to which extent the nail should be filed in order to perform the shape adjustment therefor to the model nail image M can be confirmed before the shape adjustment.

Moreover, in the event where the shape adjustment-required region extraction unit 513 extracts the shape adjustment-required region Fa, the model nail image M in which the area S of the shape adjustment-required region Fa becomes as small as possible is designated, and is proposed to the user. Accordingly, the user applies the model nail image M designated by the shape adjustment-required region extraction unit 513, whereby it is made possible for the user to adjust the nail T of his/her own to a good shape just by filing off the shape adjustment-required region Fa, which is minimum necessary, by the file and the like at the time of the shape adjustment (filing).

Then, when the shape adjustment-required region Fa is decided, the printing with a predetermined color is implemented for the whole of the region extracted as the shape adjustment-required region Fa on the corresponding nail T. In such a way, even the user who is not accustomed to the shape adjustment of the nail T can easily determine the region to be subjected to the shape adjustment (filing) by the file and the like, and can easily adjust the nail T to the desired shape. Moreover, the same is also applied to the case where the printing is implemented with a predetermined color for the boundary line between the shape adjustment-required region Fa and the other nail region.

Fourth Embodiment

Figure 22:
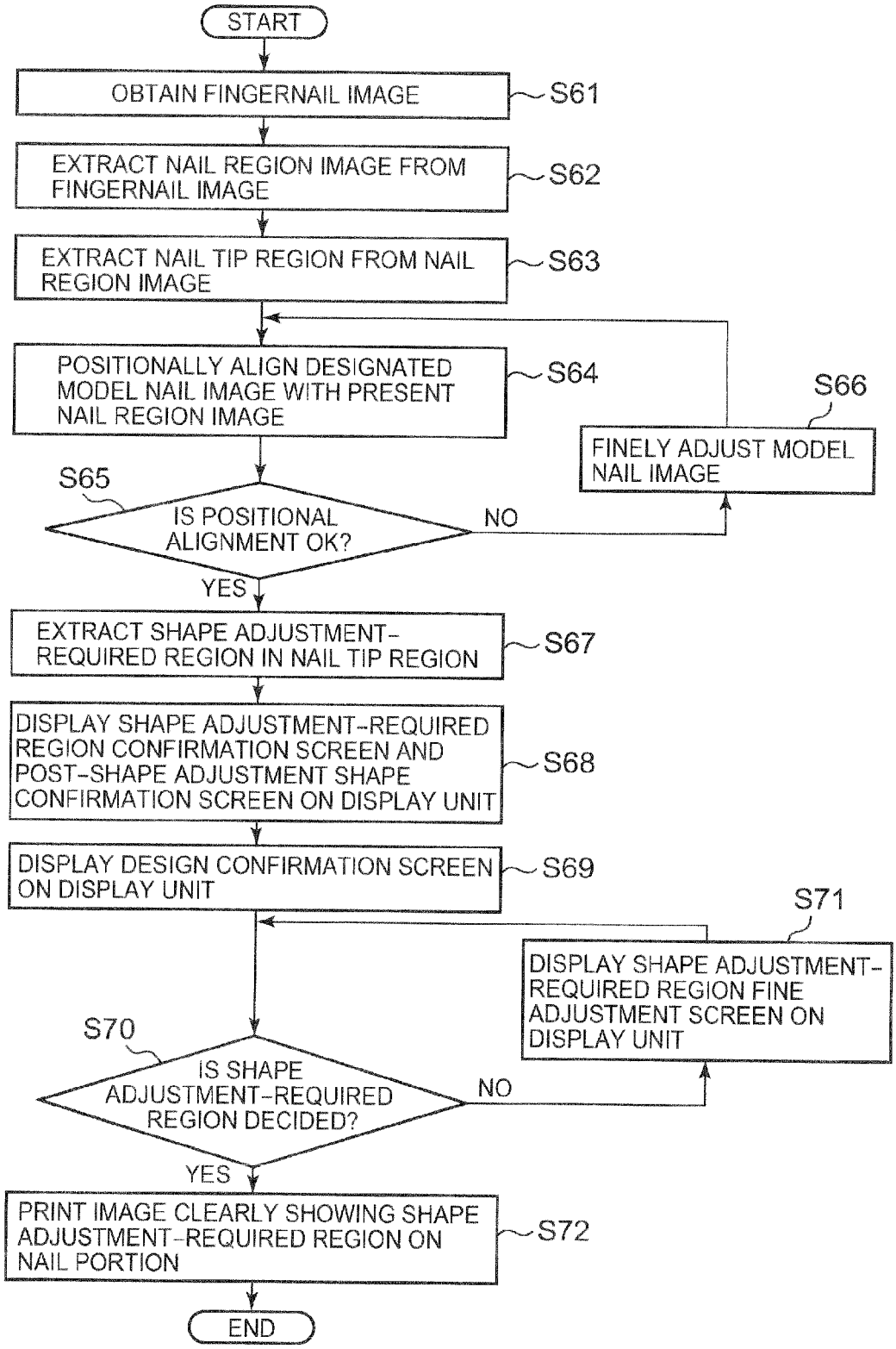
FIG. 22 is a flowchart showing printing control processing in a fourth embodiment.
Figure 24:
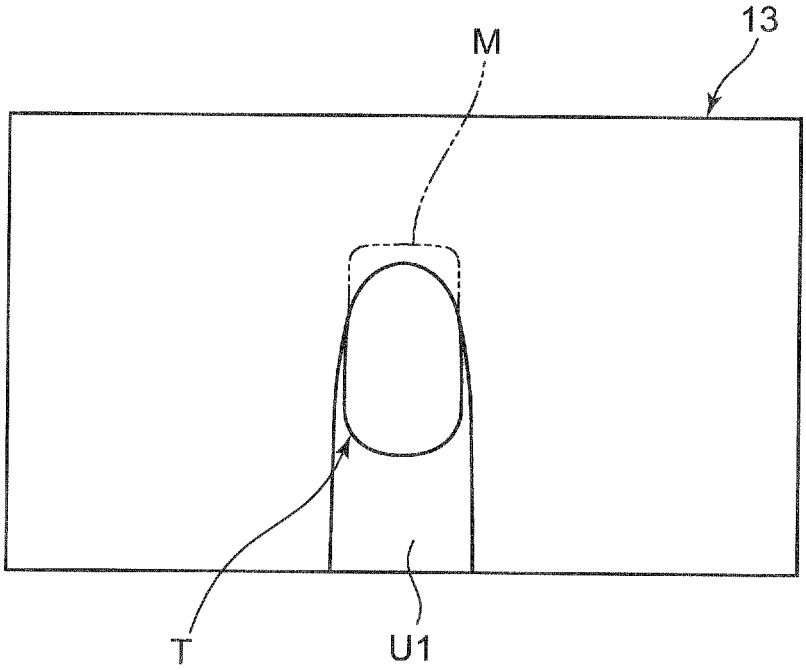
FIG. 24 is a view showing an example of the shape adjustment-required region confirmation screen in the fourth embodiment.

Next, while referring to FIG. 22 and FIG. 24, a description is made of a fourth embodiment of the nail printing device according to the present invention. Note that this embodiment is different from the first embodiment to the third embodiment in the way of extraction of the shape adjustment-required region Fa by the shape adjustment-required region extraction unit, and accordingly, in the following, a description is particularly made of points where this embodiment is different from the first embodiment to the third embodiment.

A device configuration of the nail printing device in this embodiment is similar to those described in the first embodiment to the third embodiment, and accordingly, a description thereof is omitted.

In this embodiment, for the purpose of positionally aligning the model nail image M, which is designated by the user, with the nail region image of the present nail T of the user, and achieving a nail tip shape which the user desires to realize in the future, the shape adjustment-required region extraction unit 513 proposes how the shape of the present nail T be adjusted (filed).

That is to say, when the model nail image M is designated by the user, the shape adjustment-required region extraction unit 513 positionally aligns the designated model nail image M with the nail region image of the present nail T of the user, and extracts the shape adjustment-required region Fa in the nail tip region Np.

Figure 23:
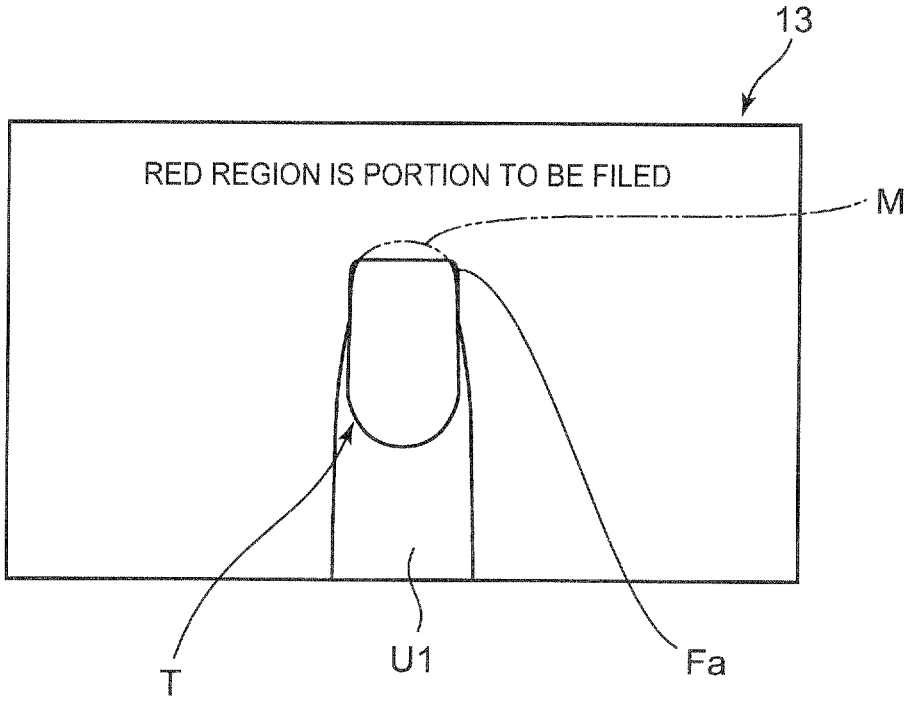
FIG. 23 is a view showing an example of a shape adjustment-required region confirmation screen in the fourth embodiment.

On the display unit 13, such an image, for example, as shown in FIG. 23 and FIG. 24, in which the model nail image M is positionally aligned with the nail region image of the present nail T of the user, is displayed as the shape adjustment-required region confirmation screen.

Here, the shape adjustment-required region extraction unit 513 extracts, as the shape adjustment-required region Fa, the region located outward from the outline of the model nail image M in the nail tip region Np of the nail region image of the present nail T of the user.

In the case where the nail tip region Np of the present nail T of the user hangs outward from the outline of the model nail image M only slightly (for example, refer to FIG. 23), only a hanging region is extracted as the shape adjustment-required region Fa.

Moreover, in the case where the length of the present nail T of the user is short, or the tip end portion thereof is more slender than the model nail image M designated by the user (for example, refer to FIG. 24), there is no portion that can be extracted as the shape adjustment-required region Fa, and accordingly, on the display unit 13, there is displayed an image in which the model nail image M is positionally aligned with the nail region image of the nail T of the user, followed by superimposition, and a nail tip shape desired by the user is indicated by a chain double-dashed line or the like. In this case, on the display screen of the display unit 13, a comment telling that the shape adjustment-required region Fa is not present, and the like may be displayed in combination.

Note that, since other configurations are similar to those described in the first embodiment to the third embodiment, a description thereof is omitted.

Next, while referring to FIG. 22 to FIG. 24, a description is made of a printing control method of the nail printing device in this embodiment.

In a similar way to the first embodiment and the second embodiment, also in this embodiment, the user refers to the nail shape designation screen (refer to FIG. 8) and the like, which are displayed on the display unit, and designates the desired model nail image M and the nail design D desired to be printed.

When the user inserts the printing finger U1 into the printing finger insertion portion 20*a*, first, as shown in FIG. 22, the fingernail image of the user is obtained by the pick-up unit 30 (Step S61). Then, the nail region image is extracted from this fingernail image (Step S62), and further, the nail tip region Np is extracted from the nail region image (Step S63). The shape adjustment-required region extraction unit 513 positionally aligns the model nail image M, which is designated by the user, with the nail region image of the present nail T of the user (Step S64), and always determines whether or not the positional alignment is completed (Step S65). In the case where the positional alignment is not completed (Step S65: NO), the designated model nail image M is finely adjusted (Step S66), and pieces of the processing of Steps S64 and S65 are repeated.

On the other hand, in the case where the positional alignment of both is completed (Step S65: YES), the shape adjustment-required region extraction unit 513 extracts, as the shape adjustment-required region Fa, the region located outward from the outline of the designated model nail image M in the nail tip region Np of the nail T (Step S67).

When the shape adjustment-required region Fa is extracted, then on the display screen of the display unit 13, there are displayed: the shape adjustment-required region confirmation screen (refer to FIG. 10) in which the shape adjustment-required region Fa is colored with a conspicuous color such as red; and the post-shape adjustment shape confirmation screen (refer to FIG. 11) that shows into which shape the shape adjustment-required region Fa is formed in the case of being filed by the file and the like (Step S68). Moreover, in the case where the nail design D desired to be printed on the nail T is designated by the user, the design confirmation screen (refer to FIG. 12) in which the designated nail design D is superimposed on the shape of the nail T already subjected to the shape treatment is displayed (Step S69).

Note that, in the case where the shape adjustment-required region Fa is not present since the present nail T of the user is too short or too slender in width than the designated model nail image M, that is, in the case where the region located outward from the outline of the model nail image M in the nail tip region Np is not present, then on the displayed unit 13, the image is displayed, in which the outline of the model nail image M is indicated as the nail tip shape, which should be targeted in the future, by the chain double-dashed line or the like, and is superimposed on the nail region image of the user. In this case, the image may be displayed together with a comment telling that the shape adjustment-required region Fa to be filed is not present at present. Moreover, for example, there is considered the case where the model nail image M desired to be targeted in the future has a shape such as the point (refer to FIG. 8) in which the tip end is slender, and the nail tip region Np of the present nail T has a shape such as the square in which there are corners on end portions. In the case where it is preferable to transiently perform shape adjustment (filing) of filing both side portions of the tip end of the present nail tip region Np in order to achieve the model nail image M in the future in this case, the region to be subjected to the shape adjustment may be displayed as the shape adjustment-required region Fa while coloring the same with a different color from that for other area even in the case where the region concerned is located inward from the outline of the model nail image M.

The control unit 51 always determines whether or not the shape adjustment-required region Fa is decided in such a manner that the user operates the OK button (not shown) and the like (Step S70). In the case where it is determined that the shape adjustment-required region Fa is decided (Step S70: YES), the printing control unit 514 controls the printing unit 40, and the printing of a predetermined color such as red is performed on the region extracted as the shape adjustment-required region Fa (Step S72). Note that, in the case where the shape adjustment-required region Fa to be filed is not present at present, the printing is not performed even if the OK button and the like are operated. In this case, preferably, warning display and the like, which tell the effect that the shape adjustment-required region Fa to be filed is not present at present, are performed.

On the other hand, in the case where it is determined that the shape adjustment-required region Fa is not decided (Step S70: NO), the shape adjustment-required region fine adjustment screen (refer to FIG. 13 and FIG. 14) is displayed. The user operates the fine adjustment buttons 122, thereby adjusting the longitudinal length and lateral width of the shape adjustment-required region Fa while confirming the shape adjustment-required region fine adjustment screen. The control unit 51 always determines whether or not the shape adjustment-required region Fa is decided in such a manner that the user operates the OK button (not shown) and the like (Step S70). In the case where it is determined that the shape adjustment-required region Fa is decided (Step S70: YES), the printing control unit 514 controls the printing unit 40, and the printing of a predetermined color such as red is performed on the region extracted as the shape adjustment-required region Fa (Step S72). Note that, in a similar way to the above-mentioned case, the printing is not performed in the case where the shape adjustment-required region Fa to be filed is not present at present.

As described above, in a similar way to the first embodiment, in accordance with the nail printing device in this embodiment, the model nail image M is positionally aligned with the nail region image of the nail T, and the region located outward from the outline of the model nail image M in the nail tip region Np of the nail T is extracted as the shape adjustment-required region Fa, and the image (refer to the shape adjustment-required region confirmation screen of FIG. 10) clearly showing the shape adjustment-required region Fa thus extracted is displayed on the display screen.

In such a way, where and to which extent the nail T should be filed in order to perform the shape adjustment therefor to the model nail image M can be confirmed before the shape adjustment.

Moreover, in the event where the shape adjustment-required region extraction unit 513 extracts the shape adjustment-required region Fa, the model nail image M designated by the user and the present nail T of the user are positionally aligned with each other. In the case where the region is present, which is located outward from the outline of the model nail image M in the nail tip region Np, then the display clearly showing that the region concerned is the shape adjustment-required region Fa is displayed on the display unit 13. Note that, in the case where the region is not present, which is located outward from the outline of the model nail image M in the nail tip region Np, then the nail region image of the fingernail image of the user and the outline of the model nail image M are simply superimposed on each other and are displayed on the display unit.

Therefore, in the case where an ideal nail shape (model nail image M) desired to be achieved in the future cannot be realized by the present nail T though the model nail image M is present, then the user can be allowed to recognize a shift between the model nail image M concerned and the shape of the present nail T of the user.

For example, in the case where the user desires to adjust the nail to the square-off (model nail image M4 in FIG. 8) in the future, such a square-off shape cannot be realized until the whole of the nail T grows if the nail tip region Np is filed too slenderly. In this point, in this embodiment, how the shape of the present nail T should be adjusted in order to achieve the ideal nail shape (model nail image M) is indicated. Accordingly, the user can be prevented from filing the nail T too much by mistake and spending an extra time for realizing the ideal nail shape (model nail image M).

Then, in the case where the shape adjustment-required region Fa is present, the shape adjustment-required region Fa concerned is printed on the nail T of the user. In such a way, for example, in the case where there is a portion to be transiently subjected to the shape adjustment in order to achieve the ideal nail shape though the nail T of the user is short and the ideal nail shape (model nail image M) cannot be realized at present, the portion concerned can be clearly shown with accuracy. The user can perform the shape adjustment (filing), which is the most suitable for realizing the desired nail shape efficiently just by filing the printed region. The same is also applied to the case where the printing is implemented with a predetermined color for the boundary line between the shape adjustment-required region Fa and the other nail region.

Note that, though the description has been made above of the embodiments of the present invention, it is needless to say that the present invention is not limited to such embodiments and is modifiable in various ways within the scope without departing from the spirit thereof.

For example, in each of the above-described embodiments, the nail printing device 1 capable of simultaneously performing the processing such as the printing for the four fingers is taken as an example; however, the present invention is also applicable to a device that receives the insertion of the fingers one by one and sequentially performs the processing such as the printing therefor. Moreover, the nail printing device may be a device that can simultaneously perform the processing for the fingers of both hands.

Moreover, in this embodiment, as an example, the case is taken, where the nail printing device 1 can also designate the variety of nail designs D to be implemented for the nail T as well as the image clearly showing the shape adjustment-required region Fa; however, the matters that the nail designs D can be designated and that the designated nail designs D are printed on the nail T are not essential in the nail printing device according to the present invention, and the nail printing device according to the present invention does not have to include such functions as described above.

Note that, in the case where the nail printing device 1 is a special purpose machine for printing the image clearly showing the shape adjustment-required region Fa, the nail printing device 1 just needs to include the printing head 46 that ejects the ink of a predetermined color (for example, red and the like) for printing the region extracted as the shape adjustment-required region Fa or the boundary line between the shape adjustment-required region Fa and the other nail region, and to include the ink cartridge thereof.

Moreover, in the above-described second embodiment, as an example, the case is taken, where, in the case where there are variations among the plurality of printing fingers U1 in the length dimensions L of the nail tip regions Np already subjected to the shape adjustment, then the minimum value of the length dimensions L is detected, and also with regard to other fingers, the lengths of such post-shape adjustment nail tip regions Np thereof are changed so that the length dimensions L of the post-shape adjustment nail tip regions Np can become the same as this minimum value, and the shape adjustment-required regions Fa in the nail tip regions Np are extracted so that this condition can be satisfied. However, the way of balancing the length dimensions L among the plurality of printing fingers U1 is not limited to this.

For example, with regard to all of the printing fingers U1, the length dimensions L of the nail tip regions Np of the respective fingers may be adjusted so as to become maximum values for each of the fingers in order that the shape adjustment-required regions Fa can become the smallest. In this case, since the regions to be subjected to the shape adjustment are small, an operation time required for the shape adjustment of all of the fingers can be reduced, and this is preferable in the case where the user does not desire to take a time for the shape adjustment (filing).

Moreover, in response to lengths of the fingers, adjustment can be performed so that the length dimensions L of the nail tip regions Np can become larger as the lengths of the fingers are being shorter. In the case of performing this adjustment, variations in the lengths of the entire fingers including the lengths of the nails T can be reduced, and this is preferable in the case where the user desires to equalize the lengths of the fingers to one another.

Moreover, references in the event of measuring the length dimensions L of the nail tip regions Np of the respective fingers are not limited to the free edges E described in this embodiment. Here, portions where end portions in the width direction of the nails T leave the fingers (skins) are taken as the references. The portions concerned are referred to as "stress points", and are shown as stress points Sp in FIG. 9 and FIG. 19. Then, for example, while taking the stress points Sp as the references, lengths from lines, each of which horizontally connects the right and left stress points Sp of the nail T to each other, to the tip end portions of the nails T may be used as the length dimensions L serving as references in the event of balancing the respective fingers.

Moreover, in the above-described third embodiment, as the model nail images in the event of extracting the shape adjustment-required region Fa, the shape adjustment-required region extraction unit 513 extracts the model nail images Min order from the smaller area S of the shape adjustment-required region Fa, and proposes the extracted model nail images M to the user. However, away of giving priority in the event where the shape adjustment-required region extraction unit 513 designates the model nail images is not limited to that illustrated here.

For example, in the case where the user designates the nail design D, the model nail images M may be designated in order from that determined to be more suitable for the nail design D concerned, and may be proposed to the user.

Moreover, in the case where the model nail images M designated by the user in the past are present, the model nail images M may be stored in the storage unit in advance, may be designated in order from a model nail image M in which the number of designation times by the user is larger or from a model nail image M in which a designation date by the user is later, and may be proposed to the user.

It is needless to say that, besides the above, the present invention is not limited to the embodiments and is changeable as appropriate.

The description has been made above of some embodiments of the present invention; however, the scope of the present invention is not limited to the above-mentioned embodiments, and incorporates the scope of claims described in claims and equivalents to the scope of claims.

What is claimed is:

1. A nail printing device comprising:

a printing head which implements printing for a nail of a finger;

a fingernail image obtaining unit which picks up an image of a region containing the nail, and obtains a nail region image from the picked-up image;

a nail tip region extraction unit which extracts a nail tip region of the nail, the nail tip region not overlapping a nail bed of the finger, from the nail region image;

a shape adjustment-required region extraction unit which (i) positionally aligns each of a plurality of model nail images with the nail region image, (ii) extracts, as a shape adjustment-required region, a region which is located outward of an outline of the model nail image in the nail tip region and which needs to be removed, for each of the plurality of model nail images, and (iii) calculates an area of each of the extracted shape adjustment-required regions; and a nail shape designation unit which designates first, as a specific model nail image, a model nail image from among the plurality of model nail images for which the calculated area of the extracted shape adjustment-required region is the smallest;

wherein each model nail image serves as a model for adjusting a shape of the nail tip region, and the plurality of model nail images are registered in advance and are different from one another in at least one of size and shape.

2. The nail printing device according to claim 1, further comprising:

a printing control unit which, using the specific model nail image, controls the printing head to implement printing with a predetermined color for the region extracted as the shape adjustment-required region or a boundary line between the shape adjustment-required region and another nail region.

3. The nail printing device according to claim 2, wherein:

the printing control unit implements the printing with the predetermined color in a case where it is determined that the shape adjustment-required region is decided, and in a case where it is determined that the shape adjustment-required region is not decided, the printing control unit adjusts a longitudinal length and a lateral width of the shape adjustment-required region, and implements the printing with the predetermined color, after it is determined that the shape adjustment-required region is decided.

4. The nail printing device according to claim 1, further comprising a shape adjustment-required region display unit which displays, on a display screen, an image clearly showing the shape adjustment-required region.

5. The nail printing device according to claim 4, wherein the shape adjustment-required region display unit displays, on the display screen, an image colored with a color capable of distinguishing the shape adjustment-required region from another region, the image belonging to the nail region image, or an image showing a boundary line between the shape adjustment-required region and another nail region, the image belonging to the nail region image, as the image clearly showing the shape adjustment-required region.

6. The nail printing device according to claim 5, wherein, on the display screen, a comment clearly showing the shape adjustment-required region is displayed together with the image clearly showing the shape adjustment-required region.

7. The nail printing device according to claim 1, wherein, in a case where there is no portion extractable as the shape adjustment-required region, an image in which the model nail image is positionally aligned with and superposed on the nail region image and the outline of the model nail image is indicated by a chain line is displayed on the display screen.

8. The nail printing device according to claim 7, wherein, in the case where there is no portion extractable as the shape adjustment-required region, a comment indicating that the shape adjustment-required region is not present is displayed in combination on the display screen.

9. The nail printing device according to claim 1, wherein:

the image picked up by the fingernail image obtaining unit contains a plurality of fingers, and the fingernail image obtaining unit obtains a fingernail image containing the nail region image for respective nails corresponding to the plurality of fingers, the shape adjustment-required region extraction unit extracts the shape adjustment-required region from the nail region image of the respective nails of the plurality of fingers for which respective fingernail images have been obtained by the fingernail image obtaining unit, and in an event of extracting the shape adjustment-required region, the shape adjustment-required region extraction unit extracts the shape adjustment-required region of the respective nails so that a length dimension from a free edge on a nail bed side of the nail tip region to a tip end portion of the respective nails is equal for each of the respective nails of the plurality of fingers.

10. A printing control method of a nail printing device, the printing control method comprising:

picking up an image of a region containing a nail of a finger, and obtaining a nail region image from the picked-up image;

extracting a nail tip region of the nail, the nail tip region not overlapping a nail bed of the finger, from the nail region image;

positionally aligning each of a plurality of model nail images with the nail region image, each model nail image serving as a model in an event of adjusting a shape of the nail tip region, and the plurality of model nail images being registered in advance and being different from one another in at least one of size and shape;

extracting, as a shape adjustment-required region, a region which is located outward of an outline of the model nail image in the nail tip region and which needs to be removed, for each of the plurality of model nail images;

calculating an area of each of the extracted shape adjustment-required regions; and designating first, as a specific model nail image, a model nail image from among the plurality of model nail images for which the calculated area of the extracted shape adjustment-required region is the smallest.

11. The printing control method according to claim 10, further comprising controlling, using the specific model nail image, a printing with a predetermined color for the region extracted as the shape adjustment-required region or a boundary line between the shape adjustment-required region and another nail region.

12. The printing control method according to claim 11, wherein:

in the controlling the printing, the printing with the predetermined color is implemented in a case where it is determined that the shape adjustment-required region is decided, and in a case where it is determined that the shape adjustment-required region is not decided, in the controlling the printing, a longitudinal length and a lateral width of the shape adjustment-required region are adjusted, and the printing with the predetermined color is implemented, after it is determined that the shape adjustment-required region is decided.

13. The printing control method according to claim 10, further comprising displaying, on a display screen, an image clearly showing the shape adjustment-required region.

14. The printing control method according to claim 13, wherein in the displaying the shape adjustment-required region, the display screen displays an image colored with a color capable of distinguishing the shape adjustment-required region from another region, the image belonging to the nail region image, or an image showing a boundary line between the shape adjustment-required region and another nail region, the image belonging to the nail region image, is displayed, as the image clearly showing the shape adjustment-required region.

15. The printing control method according to claim 14, wherein, on the display screen, a comment clearly showing the shape adjustment-required region is displayed together with the image clearly showing the shape adjustment-required region.

16. The printing control method according to claim 10, wherein, in a case where there is no portion extractable as the shape adjustment-required region, an image in which the model nail image is positionally aligned with and superposed on the nail region image and the outline of the model nail image is indicated by a chain line is displayed on the display screen.

17. The printing control method according to claim 16, wherein, in the case where there is no portion extractable as the shape adjustment-required region, a comment indicating that the shape adjustment-required region is not present is displayed in combination on the display screen.

18. The printing control method according to claim 10, wherein:

the picked-up image contains a plurality of the fingers, and the obtaining the nail region image from the picked-up image includes obtaining a fingernail image containing the nail region image for respective nails corresponding to the plurality of fingers, in the extracting the shape adjustment-required region, the shape adjustment-required region is extracted from the nail region image of the respective nails of the plurality of fingers for which respective fingernail images have been obtained, and in the extracting the shape adjustment-required region, the shape adjustment-required region of the respective nails is extracted so that a length dimension from a free edge on a nail bed side of the nail tip region to a tip end portion of the respective nails is equal for each of the respective nails of the plurality of fingers.

* * * * *